US011117395B2

(12) United States Patent
Nishimura et al.

(10) Patent No.: US 11,117,395 B2
(45) Date of Patent: Sep. 14, 2021

(54) DRYING DEVICE AND PRINTER

(71) Applicants: Hideaki Nishimura, Kanagawa (JP); Masato Mitsuhashi, Kanagawa (JP)

(72) Inventors: Hideaki Nishimura, Kanagawa (JP); Masato Mitsuhashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/901,003

(22) Filed: Jun. 15, 2020

(65) Prior Publication Data

US 2021/0016578 A1 Jan. 21, 2021

(30) Foreign Application Priority Data

Jul. 16, 2019 (JP) ..... JP2019-131342
Apr. 8, 2020 (JP) ..... JP2020-069504

(51) Int. Cl.

| | |
|---|---|
| ***F26B 3/20*** | (2006.01) |
| ***B41J 2/01*** | (2006.01) |
| ***B41J 11/00*** | (2006.01) |
| ***F26B 13/08*** | (2006.01) |
| ***F26B 13/18*** | (2006.01) |
| ***F26B 3/30*** | (2006.01) |

(52) U.S. Cl.

CPC ..... *B41J 11/002* (2013.01); *B41J 11/0055* (2013.01); *F26B 3/30* (2013.01); *F26B 13/08* (2013.01); *F26B 13/18* (2013.01)

(58) Field of Classification Search

CPC ... B41J 11/002; B41J 11/0055; B41J 11/0022; B41J 11/0024; B41J 11/0015; F26B 13/08; F26B 13/18; F26B 3/30; F26B 13/006; F26B 3/04; F26B 3/20

See application file for complete search history.

(56) References Cited

U.S. PATENT DOCUMENTS

| | | | | |
|---|---|---|---|---|
| 2016/0263914 | A1* | 9/2016 | Hoshino | B41J 11/002 |
| 2017/0266990 | A1* | 9/2017 | Yoshinuma | B41J 11/00242 |
| 2017/0266991 | A1* | 9/2017 | Onodera | B41J 11/002 |
| 2017/0334217 | A1* | 11/2017 | Yoshinuma | B41J 11/0024 |
| 2018/0009237 | A1* | 1/2018 | Sakamoto | B41J 11/00212 |
| 2018/0264849 | A1* | 9/2018 | Kitaoka | F26B 3/04 |
| 2019/0084320 | A1* | 3/2019 | Iwasaki | B41J 11/002 |
| 2020/0164663 | A1* | 5/2020 | Nishimura | B41J 11/002 |
| 2020/0207119 | A1* | 7/2020 | Kawarada | F26B 3/04 |
| 2020/0307259 | A1* | 10/2020 | Yorimoto | F26B 13/18 |

FOREIGN PATENT DOCUMENTS

| | | |
|---|---|---|
| JP | 2018-066552 | 4/2018 |

* cited by examiner

*Primary Examiner* — Huan H Tran
(74) *Attorney, Agent, or Firm* — Xsensus LLP

(57) ABSTRACT

A drying device includes a first-heating rotator configured to contact a sheet twice from different directions, and at least three second-heating rotators each configured to contact the sheet once. The at least three second-heating rotators are in a conveyance path configured to guide the sheet to contact the first-heating rotator again after the sheet contacts and passes the first-heating rotator.

19 Claims, 25 Drawing Sheets

| REFERENCE NUMERALS OF ROLLERS | WINDING ANGLE [° ] | WINDING DISTANCE [mm] |
|---|---|---|
| 11A | 31 | 22 |
| 11B | 35 | 25 |
| 11C | 24 | 17 |
| 11D | 20 | 14 |
| 11E | 24 | 17 |
| 11F | 35 | 25 |
| 11G | 49 | 34 |
| 12 | 71 | 46 |

DRYING DEVICE AND PRINTER

CROSS-REFERENCE TO RELATED APPLICATIONS

This patent application is based on and claims priority pursuant to 35 U.S.C. § 119(a) to Japanese Patent Application No. 2019-131342, filed on Jul. 16, 2019, in the Japan Patent Office and Japanese Patent Application No. 2020-069504, filed on Apr. 8, 2020, in the Japan Patent Office, the entire disclosures of which are hereby incorporated by reference herein.

BACKGROUND

Technical Field

Aspects of the present disclosure relate to a drying device and a printer.

Related Art

As a printer to apply a liquid onto a printing object such as a sheet, there is an apparatus that includes a drying device including a heater to promote drying of the liquid applied onto the printing object.

For example, a printer includes a drying device that includes a plurality of heating rollers arranged in arc-shape around a heating drum. The drying device contacts a sheet twice with the plurality of heating rollers from different directions of the plurality of heating rollers.

SUMMARY

In an aspect of this disclosure, a drying device includes a first-heating rotator configured to contact a sheet twice from different directions, and at least three second-heating rotators each configured to contact the sheet once. The at least three second-heating rotators are in a conveyance path to guide the sheet to contact the first-heating rotator again after the sheet contacts and passes the first-heating rotator.

In another aspect of this disclosure, a drying device includes a first-heating rotator to contact a sheet twice from different directions, at least two second-heating rotators each configured to contact the sheet once. Each of the at least two second-heating rotators has a larger diameter than the first-heating rotator, and the at least two second-heating rotators are in a conveyance path to guide the sheet to contact the first-heating rotator again after the sheet contacts and passes the first-heating rotator.

In still another aspect of this disclosure, a drying device includes a heater configured to heat a sheet, at least three second-heating rotators each contact once one surface of the sheet having passed the heater, and a plurality of first-heating rotators to contact and heat the one surface of the sheet after the one surface of the sheet contacts the at least three second-heating rotators. The at least three second-heating rotators are in an interior of a conveyance path to guide the sheet to contact and pass the plurality of first-heating rotators.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
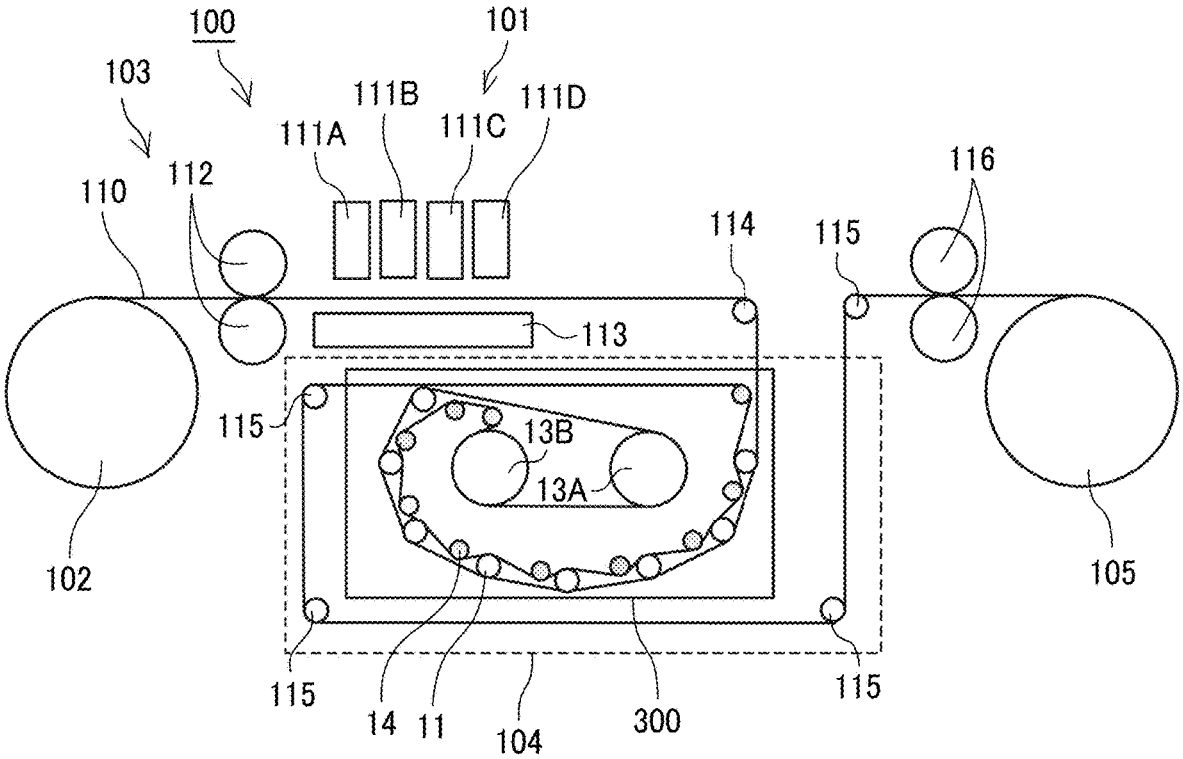
FIG. 1 is a schematic cross-sectional front view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. First, a printer as a liquid discharge apparatus according to a first embodiment of the present disclosure is described with reference to FIG. 1. FIG. 1 is a schematic cross-sectional front view of the printer according to the first embodiment of the present disclosure.

The printer 100 is an inkjet recording apparatus and includes a liquid application device 101 including a liquid discharge head, which is a liquid applicator, to discharge and apply ink, which is a liquid of desired color, onto a web 110 as a sheet such as a continuous paper. The web 110 is a print object and is also an object to be dried.

The liquid application device 101 includes, for example, full-line heads 111A, 111B, 111C, and 111D for four colors arranged from an upstream side (left side in FIG. 1) in a conveyance direction (rightward direction in FIG. 1) of the web 110. The heads 111A, 111B, 111C, and 111D apply liquids of black (K), cyan (C), magenta (M), and yellow (Y) onto the web 110, respectively. Note that the number and types of color are not limited to the above-described four colors of K, C, M, and Y and may be any other suitable number and types.

The web 110 is fed from a feeding roller 102, sent onto a conveyance guide 113 by conveyance rollers 112 of a conveyance device 103, and guided and conveyed (moved) by the conveyance guide 113. The conveyance guide 113 is disposed to face the liquid application device 101.

The web 110 onto which the liquid has been applied by the liquid application device 101 is fed to a dryer 104 including a drying device 300 according to an embodiment of the present disclosure via a guide roller 114. The dryer 104 dries the liquid applied on the web 110. The web 110 passed the dryer 104 is guided by a plurality of guide rollers 115, sent to a winding roller 105 by an ejection roller 116, and wound around the winding roller 105.

Figure 2:
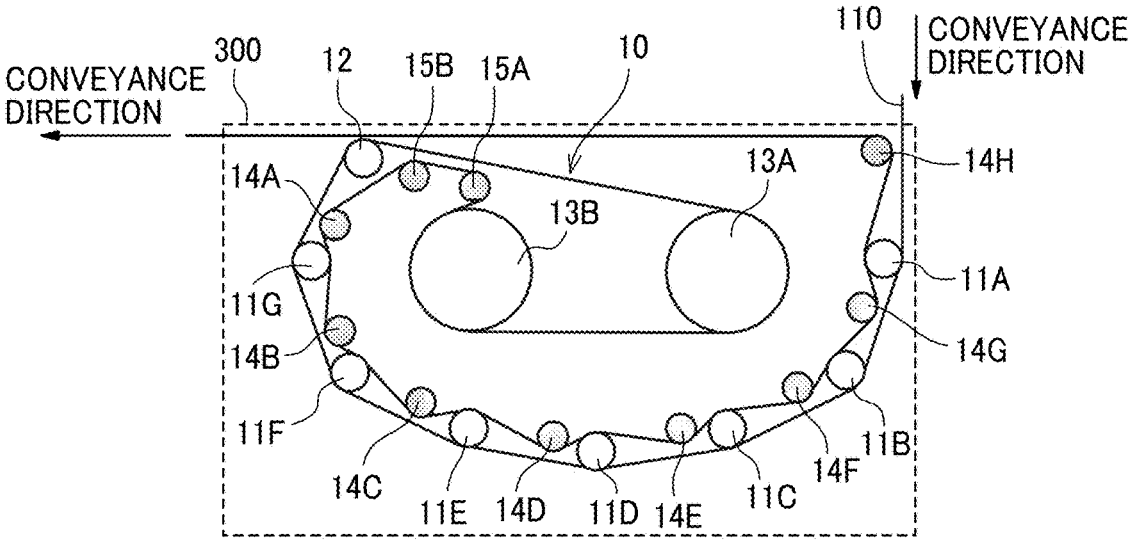
FIG. 2 is a schematic cross-sectional front view of a drying device of the printer according to the first embodiment of the present disclosure.
Figures 3, 4:
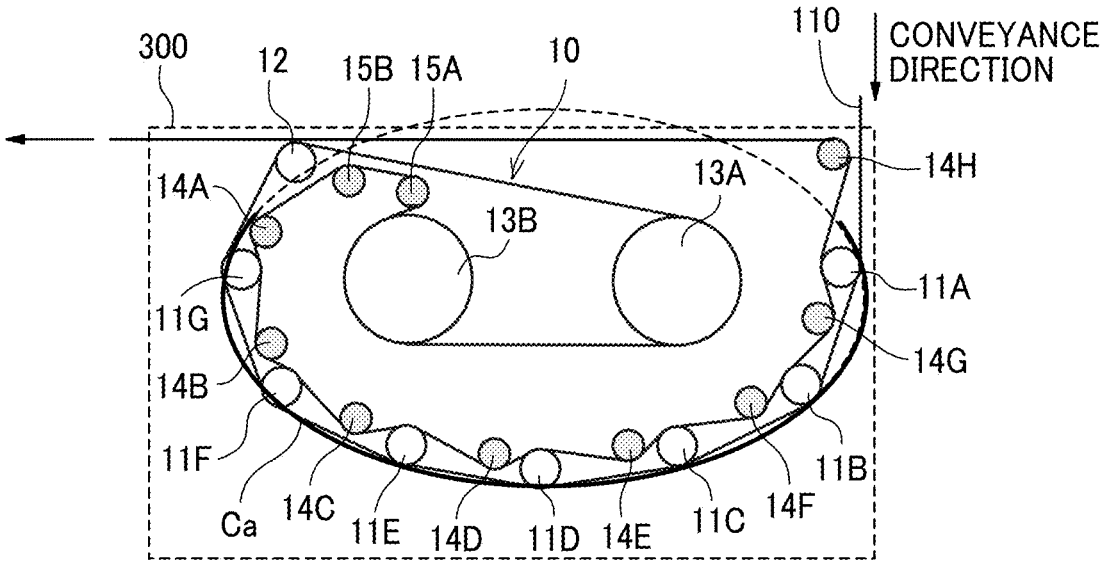
FIG. 3 is a schematic cross-sectional front view of the drying device illustrating an arrangement of heating rotators of the drying device.
FIG. 4 is a table illustrating an example of winding angles and winding distances of heat rotators.

Next, the drying device 300 according to the first embodiment of the present disclosure is described with reference to FIGS. 2 to 4. FIG. 2 is a schematic cross-sectional front view of the drying device 300 according to the first embodiment of the present disclosure. FIG. 3 is a schematic cross-sectional front view of the drying device 300 illustrating an arrangement of heating rotators of the drying device. FIG. 4 is a table illustrating an example of winding angles and winding distances of the heating rotators.

The drying device 300 includes a plurality of heating rollers 11 (11A to 11G) that contact the web 110 to heat the web 110, a heating roller 12, and two heating drums 13 (13A and 13B).

The heating rollers 11A to 11G are first-heating rotators that contacts the web 110 twice from different directions of the heating rollers 11A to 11G. The heating roller 12 and the two heating drums 13A and 13B are second-heating rotators that contacts the web 110 once. The heating roller 12 has the same diameter as the heating rollers 11A to 11G. Each of the two heating drums 13A and 13B has a larger diameter than the heating rollers 11A to 11G. The heating drums 13A and 13B have the same diameter.

As illustrated in FIG. 3, the plurality of heating rollers 11A to 11G are arranged on a locus of a substantially elliptic arc "Ca."

Two heating drums 13A and 13B are arranged inside an array of the plurality of heating rollers 11. Hereinafter, "inside the array of the plurality of heating rollers 11" means "inside an ellipse including the elliptic arc Ca."

Since the plurality of heating rollers 11A to 11G is arranged on the locus of the substantially elliptic arc Ca, contact angles (contact distances) between the plurality of heating rollers 11A to 11G and the web 110 are different for each of the plurality of heating rollers 11A to 11G. FIG. 4 illustrates examples of winding angles and winding distances (nip lengths) of the web 110 around the heating rollers 11A to 11G and the heating roller 12.

Further, the drying device 300 includes guide rollers 14 (14A to 14H) that serve as a plurality of pressing rollers to guide the web 110 to be pressed against the heating rollers 11A to 11G.

The drying device 300 in the present embodiment includes the heating roller 12, the heating drums 13A and 13B, and two guiding rollers 15A and 15B arranged in a path from the heating roller 11G to the guide roller 14A. The heating roller 12 and the heating drums 13A and 13B serve as three second-heating rotators.

The heating roller 12, the heating drums 13A and 13B, and the two guide rollers 15A and 15B configure a folding path 10. The folding path 10 guides a first surface of the web 110 to contact the heating roller 11G as the first-heating rotator again after the first surface of the web 110 contacts and passes the heating roller 11G. The first surface of the web 110 is a surface opposite to a surface of the web 110 onto which the liquid is applied. The second surface onto which the liquid is applied is also referred to as a "liquid application surface." The first surface opposite the second surface is also referred to as a "opposite surface."

Thus, the heating roller 12 and the heating drums 13A and 13B that serve as three second-heating rotators in the folding path 10.

The guide roller 15A disposed in a path between the heating drum 13B and the guide roller 14A is a rotator that defines a winding angle of the web 110 with respect to the heating drum 13B. Further, the guide roller 15B is a rotator that bridges the web 110 from the guide roller 15A to the guide roller 14A.

Each of the guide rollers 15A and 15C has a smaller diameter than each of the two second-heating rotators (heating drums 13A and 13B).

The guide rollers 14A to 14G are respectively arranged closed to the heating rollers 11G to 11A located on a downstream side (rightward side in FIG. 3) in a conveyance direction in a conveyance path among two heating rollers 11 disposed on both sides of the guide rollers 14. The conveyance direction in which the web 110 is conveyed is indicated by arrow in FIG. 3. For example, the guide roller 14B between the heating rollers 11G and 11F is arranged relatively close to (biased toward) the heating roller 11F that is located downstream of the heating roller 11G. The heating rollers 11G is located upstream of the heating rollers 11F in the conveyance direction of the web 110.

Figure 5:
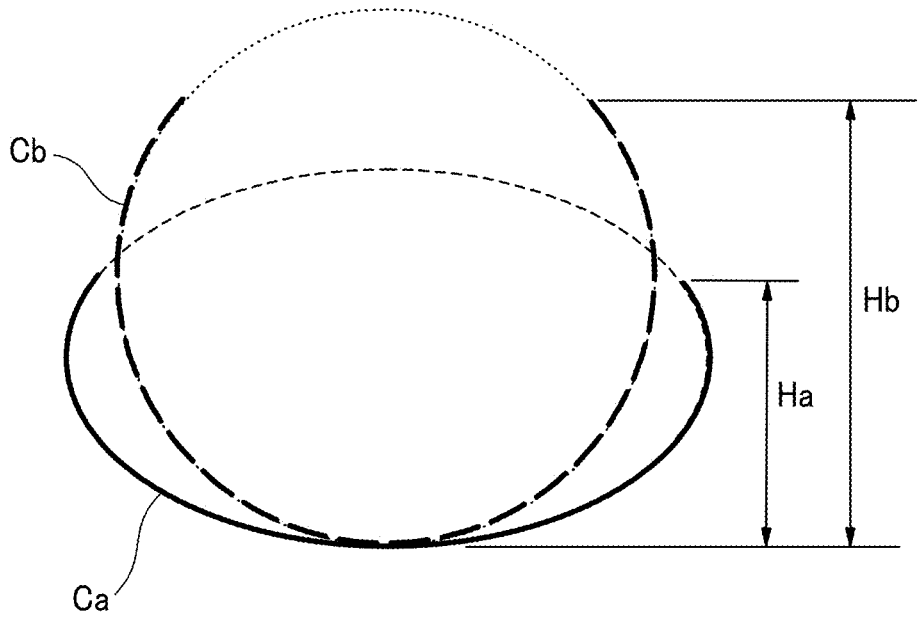
FIG. 5 is a front view of a locus of a conveyance path configured by the heating rotators.

Next, an operation effect of the first embodiment is described below with reference to FIG. 5. FIG. 5 is a front view of a locus of a conveyance path configured by the heating rotators illustrating the operation effect of the first embodiment.

The drying device 300 according to the first embodiment includes the plurality of heating rollers 11A to 11G on the locus of the substantially elliptic arc Ca as described above in FIG. 3. Two heating drums 13A and 13B are arranged inside the array of the plurality of heating rollers 11A to 11G. The above described arrangement of the plurality of heating rollers 11A to 11G and the heating drums 13A and 13B can reduce a height of the ellipse configured by the plurality of heating rollers 11 to a height "Ha" as illustrated in FIG. 5, for example. Further, "the substantially elliptic arc" does not have to be a smooth curve, and all of distances from a center to each outer circumferences are not identical. For example, in FIG. 5, a height of the conveyance path of the web 110 formed by the heating rollers 11A to 11G in a vertical direction is smaller than a width of the conveyance path of the web 110 in a horizontal direction.

Therefore, the drying device 300 according to the first embodiment can reduce a size of the drying device 300 in the height direction from Hb to Ha in FIG. 5.

Conversely, if one heating drum 13 having a heat quantity equivalent to a heat quantity of the two heating drums 13A and 13B is used, the plurality of heating rollers 11 are arranged on a locus of a perfect circle "Cb" around the one heating drum as illustrated in FIG. 5. Then, a height Hb of the locus of the perfect circle Cb configured by the plurality of heating rollers 11 becomes larger than the height Ha (Hb>Ha), for example. Thus, a size of a drying device using the one heating drum 13 is larger than a size of the drying device 300 according to the first embodiment including the two heating drums 13A and 13B.

Figure 6:
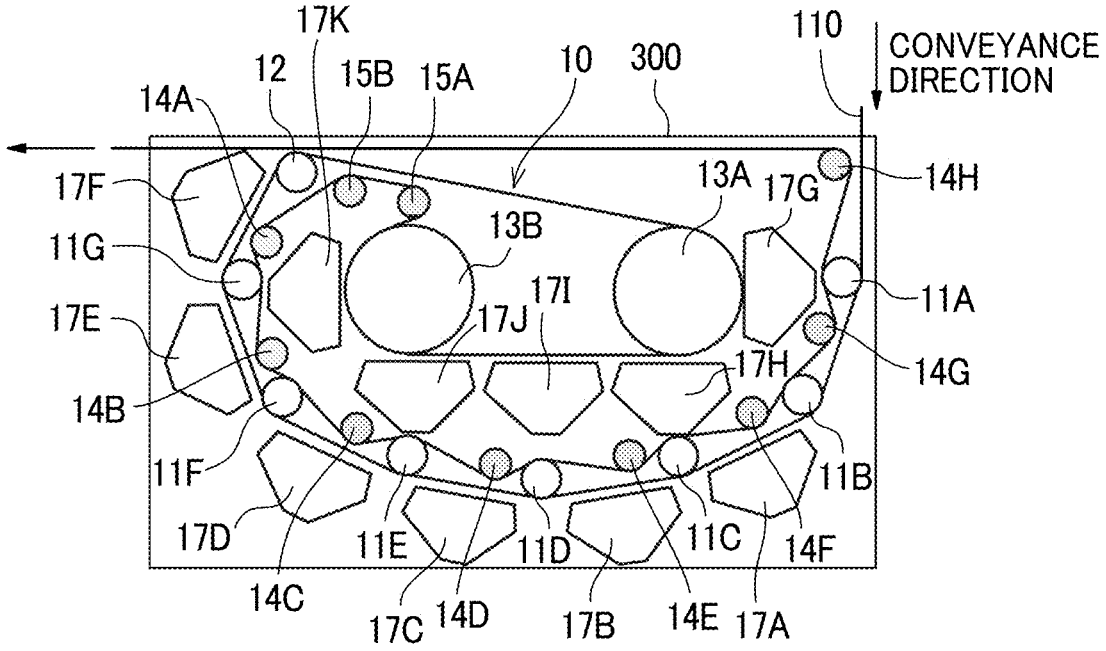
FIG. 6 is a schematic cross-sectional front view of a drying device according to a second embodiment of the present disclosure.

Next, a drying device according to a second embodiment of the present disclosure is described with reference to FIG. 6. FIG. 6 is a schematic front view of the drying device 300 according to the second embodiment.

The drying device 300 according to the second embodiment includes blowers 17 (17A to 17K) to blow an air to a liquid application surface (one surface) of the web 110 between each rollers of the heating rollers 11B to 11G, between the heating rollers 11G and 12, between the heating drums 13A and 13B, and periphery of the heating rollers 11B to 11G, the heating rollers 11G and 12, and the heating drums 13A and 13. A position and a number of the blowers 17 are not limited to a configuration as illustrated in FIG. 6.

Thus, the blowers 17 blow an air to another surface opposite to the one surface of the web 110 contacting the at least two second-heating rotators (heating roller 12 and heating drums 13A and 13B). The another surface of the web 110 faces an exterior of the drying device 300, and the blowers 17 blow the air inward of the drying device 300.

The liquid applied on the web 110 is conveyed while contacting with the heating rollers 11, the heating roller 12, and the heating drum 13 to raise a temperature of the liquid. With increase of the temperature of the liquid, a vapor pressure on a surface of the liquid increases while the blowers 17 blows a collision jet onto the surface of the liquid to promote evaporation of the liquid on the web 110.

The drying device 300 according to the second embodiment intermittently contacts the web 110 with the heating rollers 11, the heating roller 12, and the heating drum 13 to correct deformation (cockling) of the web 110 while the blowers 17 accelerates the evaporation of the liquid to improve drying property of the liquid on the web 110. The blower 17 according to the second embodiment can be applied to other embodiments.

Figure 7:
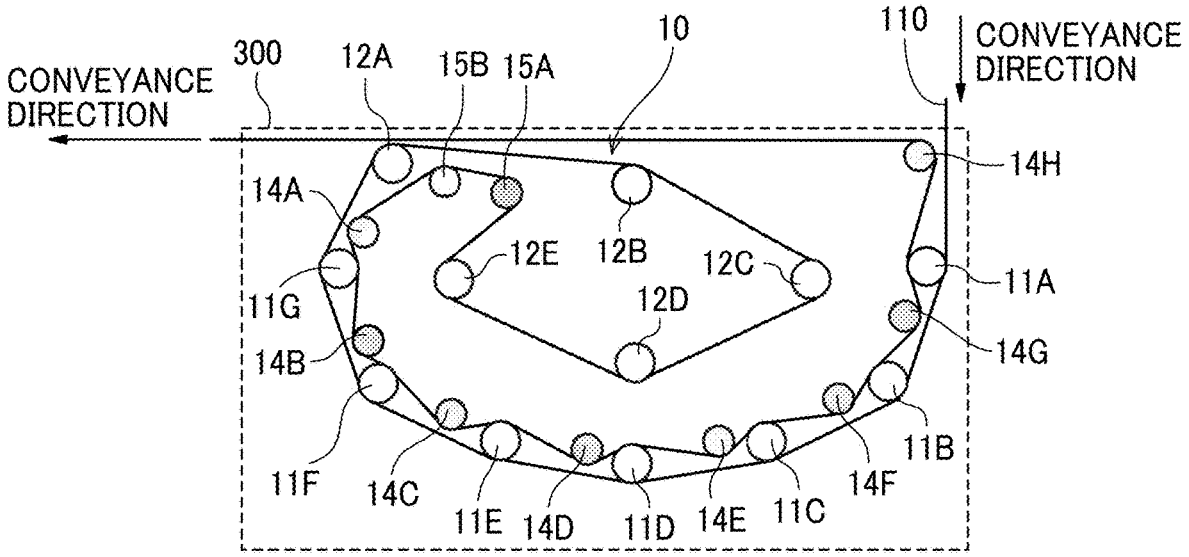
FIG. 7 is a schematic cross-sectional front view of a drying device according to a third embodiment of the present disclosure.

Next, a drying device 300 according to a third embodiment of the present disclosure is described with reference to FIG. 7. FIG. 7 is a schematic cross-sectional front view of the drying device 300 according to the third embodiment of the present disclosure.

The drying device 300 in the third embodiment includes the heating rollers 12A to 12E in the folding path 10 as the second-heating rotator. The drying device 300 includes four heating rollers 12B to 12E inside an array of the plurality of heating rollers 11. Diameters of the heating rollers 12A to 12E are the same. Diameters of the heating rollers 11 (11A to 11G) are the same. Further, the diameters of the heating rollers 12A to 12E are the same as the diameters of the heating rollers 11 (11A to 11G).

Thus, the drying device 300 can reduce a space while ensuring required drying property of the drying device 300. Further, the drying device 300 can include the first-heating rotator having the same shape with the second-heating rotator to reduce cost of the drying device 300.

Figure 8A:
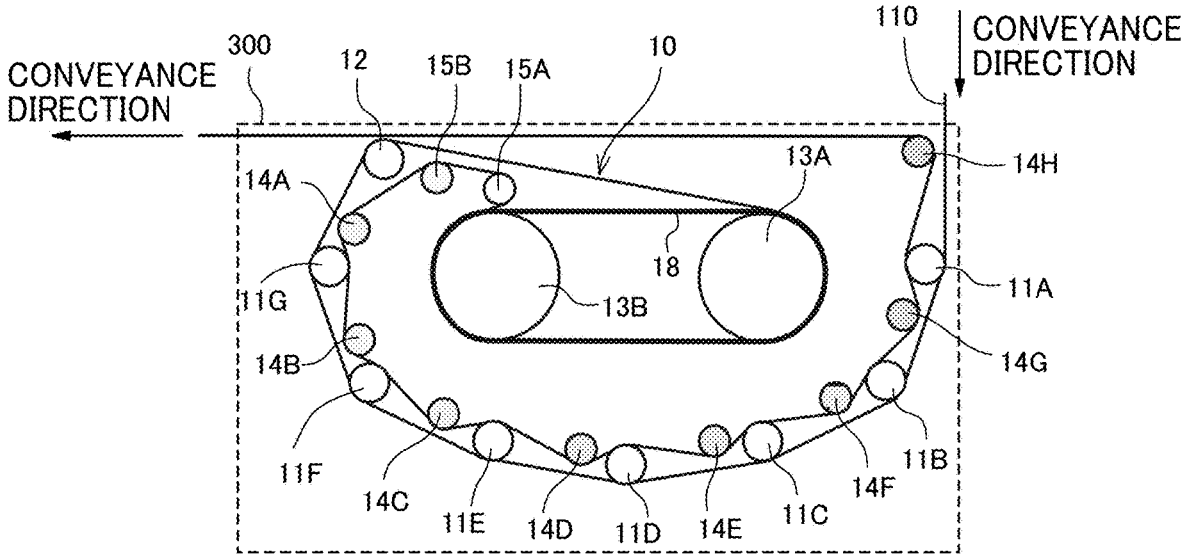
FIGS. 8A and 8B are schematic cross-sectional front views of a drying device according to a fourth embodiment of the present disclosure.
Figure 8B:
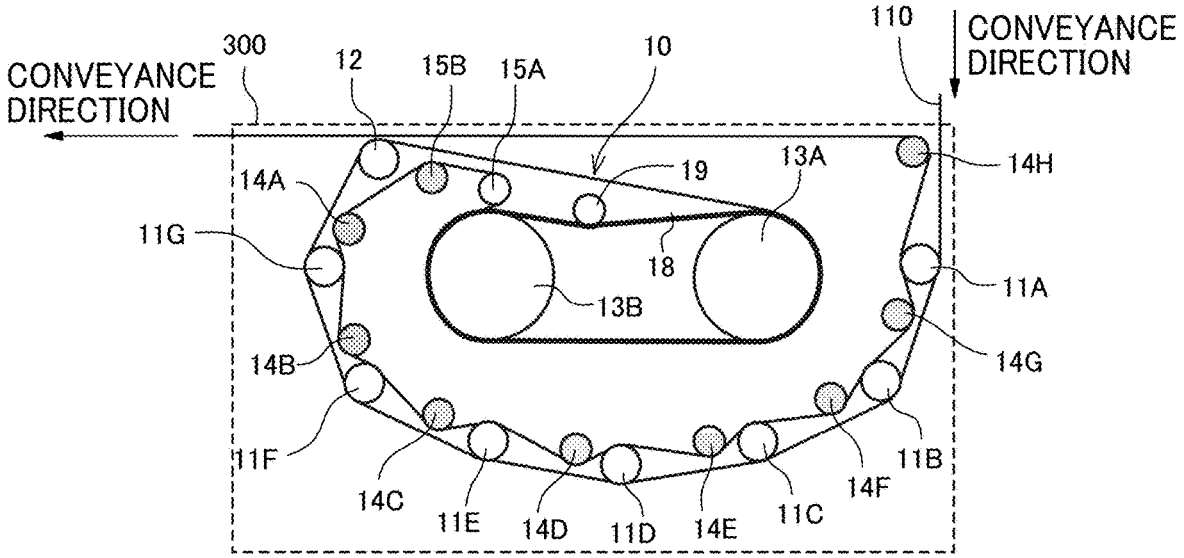

Next, different examples of the drying device 300 according to a fourth embodiment of the present disclosure are described with reference to FIGS. 8A and 8B. FIGS. 8A and 8B are schematic cross-sectional front views of difference examples of the drying device 300 according to the fourth embodiment of the present disclosure.

The drying device 300 according to the fourth embodiment includes an endless belt 18 wound around peripheral surfaces of two heating drums 13A and 13B addition to a configuration of the drying device according to the first embodiment as illustrated in FIGS. 1 to 5.

In a first example as illustrated in FIG. 8A, the belt 18 is simply wound around the heating drums 13A and 13B. In a second example as illustrated in FIG. 8B, the drying device 300 includes a tension roller 19 between the heating drums 13A and 13B to press the belt 18 inward (downward in FIG. 8B) of the belt 18 wound around the heating drums 13A and 13B.

Thus, the belt 18 comes into contact with the web 110 while being heated by the heating drums 13A and 13B so that the drying device 300 can reduce a temperature decrease of the web 110 in a path from the heating drum 13A to the heating drum 13B to further improve the drying property of the drying device 300.

Figure 9:
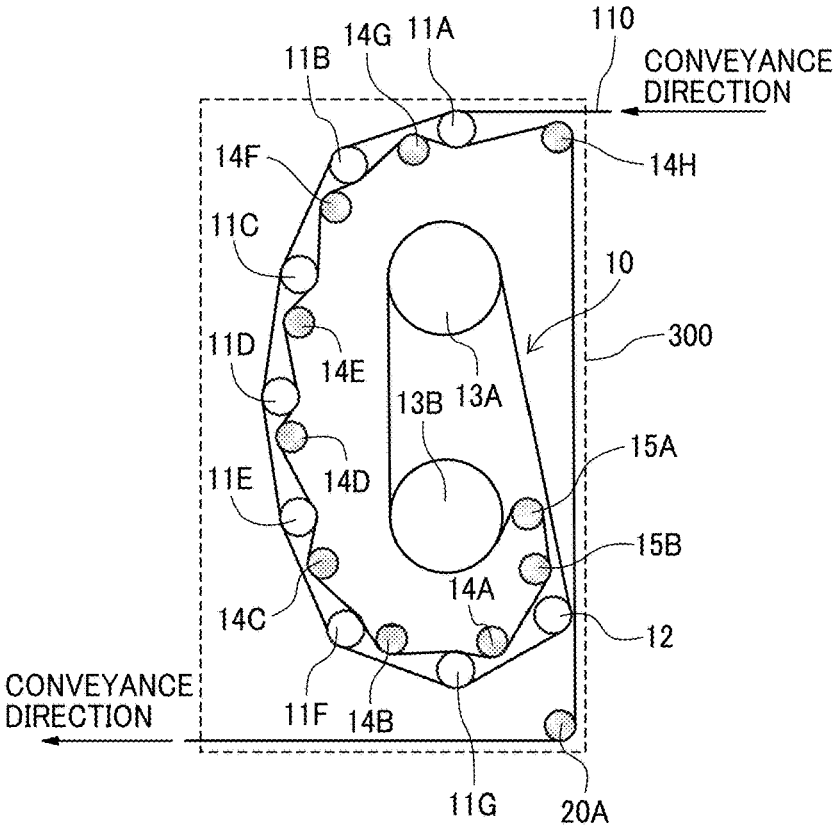
FIG. 9 is a schematic cross-sectional front view of a drying device according to a fifth embodiment of the present disclosure.

Next, a drying device 300 according to a fifth embodiment of the present disclosure is described with reference to FIG. 9. FIG. 9 is a schematic cross-sectional front view of the drying device 300 according to the fifth embodiment of the present disclosure.

The drying device 300 in the fifth embodiment includes the heating drums 13A and 13B arrayed in a vertical direction and the plurality of heating rollers 11A to 11G arranged around the heating drums 13A and 13B in an elliptic arc shape. The plurality of heating rollers 11A to 11G conveys the web 110 vertically in the drying device 300.

The drying device 300 includes a guide roller 20A to guide the web 110 outside the drying device 300 via the guide roller 14H. A surface of the web 110 coming into contacting with a heating roller 11A after entering the drying device 300 is the opposite surface (first surface) opposite to the liquid application surface (second surface) of the web 110 onto which the liquid has been applied.

Thus, the drying device 300 can reduce a size of the drying device 300 in a width direction (lateral direction or horizontal direction in FIG. 9) comparing with a drying device including a plurality of heating rollers 11 forming a conveyance path having a perfect circle shape (see perfect circle Cb of FIG. 5).

Figure 10:
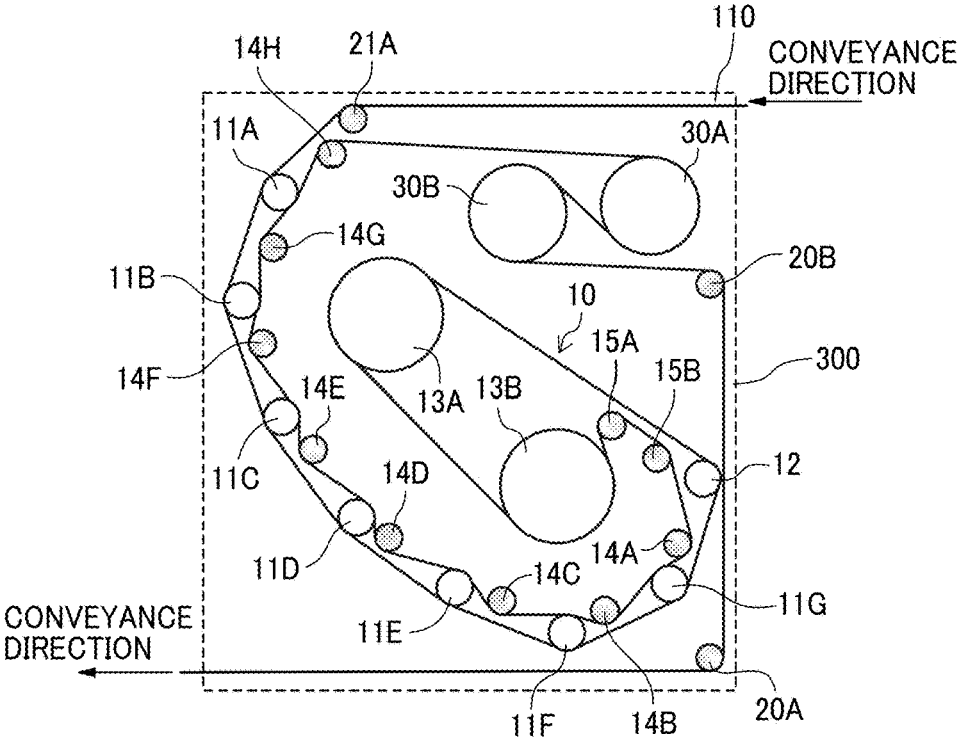
FIG. 10 is a schematic cross-sectional front view of a drying device according to a sixth embodiment of the present disclosure.

Next, a drying device 300 according to a six embodiment of the present disclosure is described with reference to FIG. 10. FIG. 10 is a schematic cross-sectional front view of the drying device 300 according to the six embodiment of the present disclosure.

The drying device 300 in the sixth embodiment includes the heating drums 13A and 13B arrayed in a direction at an angle to a horizontal direction and the plurality of heating rollers 11A to 11G around the heating drums 13A and 13B in an elliptic arc shape. The heating drum 13A is disposed higher than the heating drum 13B.

The drying device 300 further includes a guide roller 21A to guide the web 110 to the heating roller 11A. The drying device 300 further includes cooling rollers 30 (30A and 30B) serving as a cooling device to cool the web 110 that passes the guide roller 14H. The drying device 300 further includes guide rollers 20B and 20A to guide the web 110 that passes the cooling roller 30B outside the drying device 300.

The cooling roller 30A cools the second surface (liquid application surface) of the web 110 onto which the liquid has been applied. Then, the cooling roller 30B cools the first surface (opposite surface) of the web 110 opposite to the second surface (liquid application surface) onto which the liquid has been applied. The surface of the web 110 that comes into contact with the guide roller 21A after entering the drying device 300 is the first surface (opposite surface) opposite the second surface (liquid application surface) of the web 110 onto which the liquid has been applied.

Thus, the drying device 300 can cool the web 110 heated by the heating rollers 11 and 12, the heating drum 13, and the like with the cooling rollers 30A and 30B. In FIG. 10, the cooling rollers 30A and 30B may also be a drive roller.

The drying device 300 according to the sixth embodiment can efficiently use an installation space of the drying device 300 and reduce a size of the drying device 300. More specifically, the drying device 300 includes the cooling roller 30 in an upper space formed by arranging the heating drums 13A and 13B at an angle with respect to the horizontal direction so that the drying device 300 can efficiently use the installation space of the drying device 300.

Note that the arrangement of the cooling roller 30 is not limited to the above-described embodiment. For example, the drying device 300 may include the cooling roller 30 in a lower (bottom) portion of the drying device 300 by reversing the arrangement of the drying device 300 illustrated in FIG. 10 in the vertical direction. The drying device 300 including the cooling roller 30 in the lower portion of the drying device 300 can reduce an influence of heat generated and rising from the heating drum 13 and the heating rollers 11 and 12.

Figure 11:
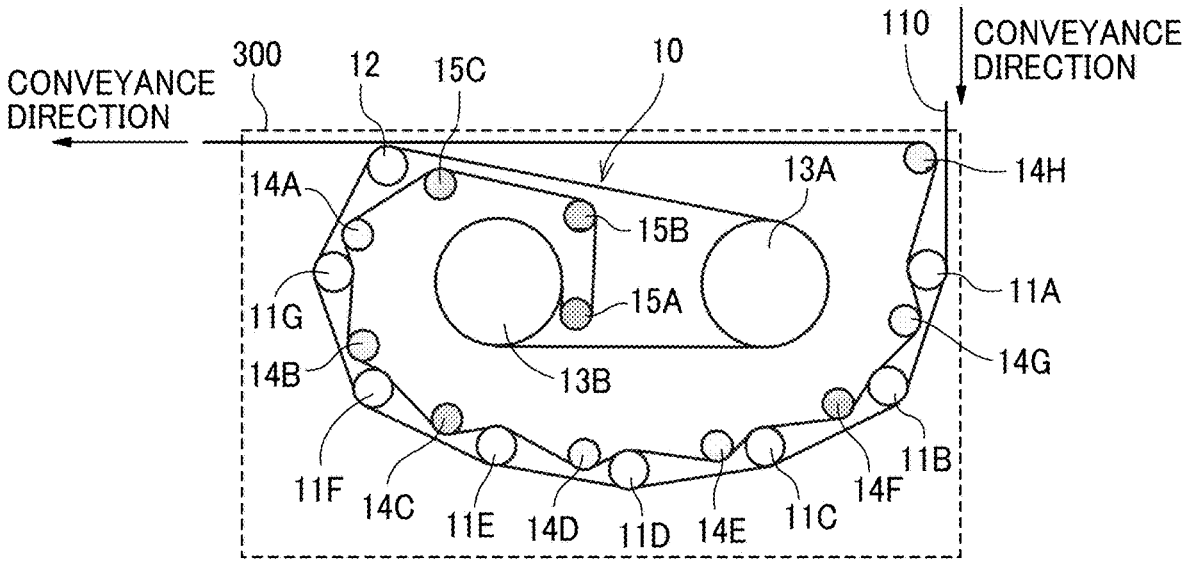
FIG. 11 is a schematic cross-sectional front view of a drying device according to a seventh embodiment of the present disclosure.

Next, a drying device 300 according to a seventh embodiment of the present disclosure is described with reference to FIG. 11. FIG. 11 is a schematic cross-sectional front view of the drying device 300 according to the seventh embodiment of the present disclosure.

The drying device 300 in the seventh embodiment includes three guide rollers 15A to 15C in a path from the heating drums 13B to the guide roller 14A in a configuration in the first embodiment. The drying device including the three guide rollers 15A to 15C can increase the winding angle of the web 110 around the heating drum 13B. A surface of the web 110 coming into contacting with the heating roller 11A after entering the drying device 300 is the first surface (opposite surface) opposite to the second surface (liquid application surface) of the web 110 onto which the liquid has been applied.

Thus, the drying device 300 can efficiently heats the web 110 with the heating drum 13B.

Figure 12A:
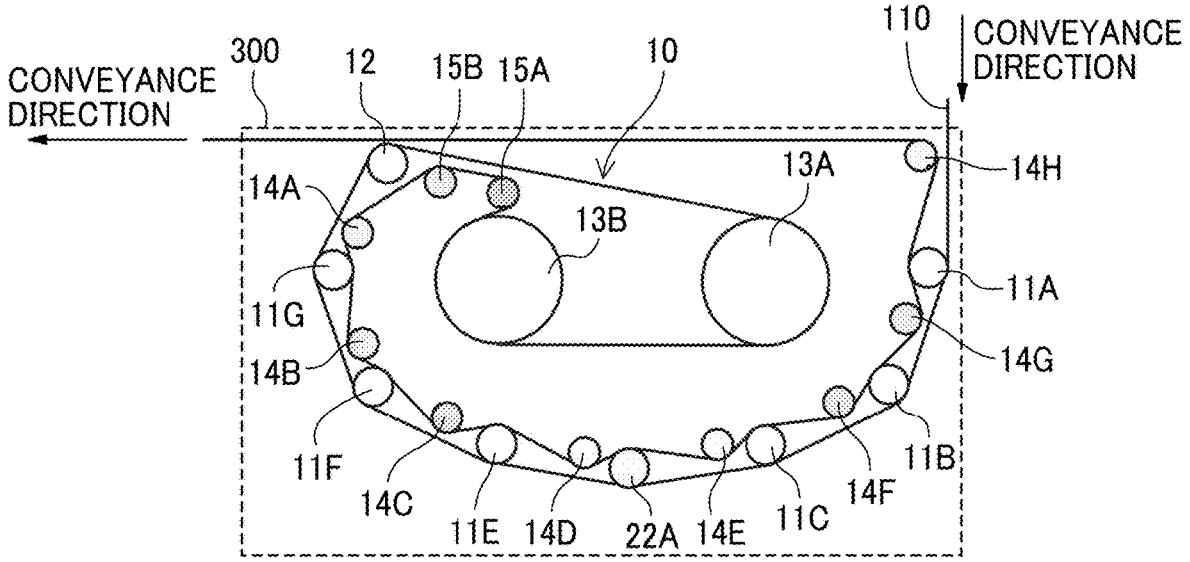
FIGS. 12A and 12B are schematic cross-sectional front view of a drying device according to an eighth embodiment of the present disclosure.
Figure 12B:
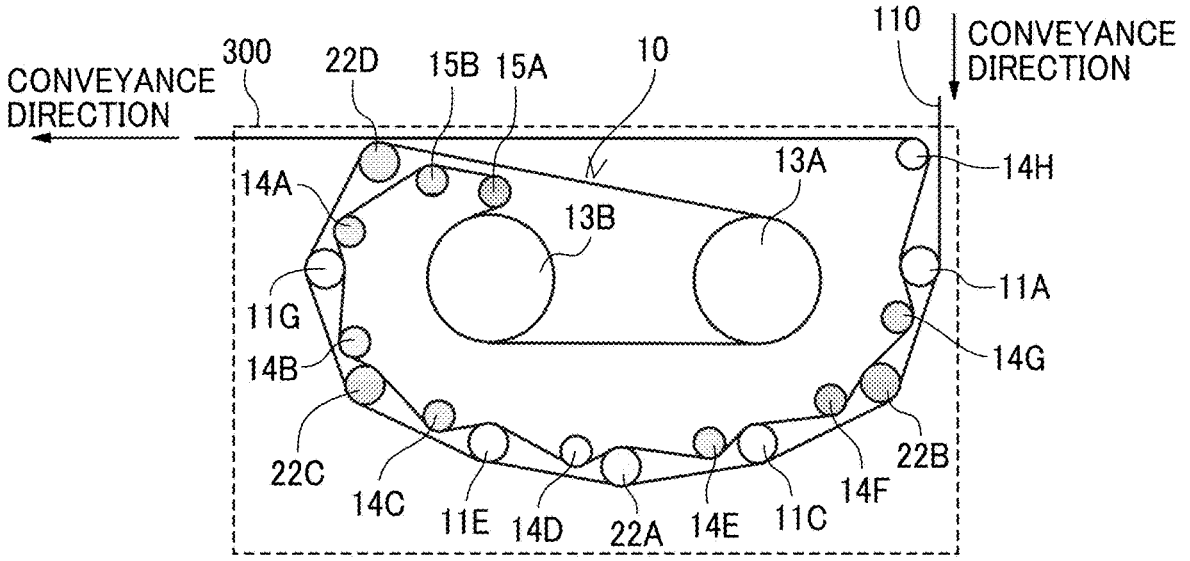

Next, different examples of the drying device 300 according to an eighth embodiment of the present disclosure are described with reference to FIGS. 12A and 12B. FIGS. 12A and 12B are schematic cross-sectional front views of difference examples of the drying device 300 according to the eighth embodiment of the present disclosure.

The drying device 300 in the eighth embodiment includes guide rollers 22 that replaces some of the heating rollers 11A to 11G and the heating roller 12 in the first embodiment. The guide rollers 22 are not the heating rollers so that the guide rollers 22 do not have a heating function but have a guiding function.

For example, in a first example illustrated in FIG. 12A, the drying device 300 includes a guide roller 22A instead of the heating roller 11D (see also FIG. 2). When the plurality of heating rollers 11 are arranged in an elliptic arc shape, the heating roller 11D at a position intersecting a minor axis of the elliptic arc shape has the smallest contact distance (contact angle) with the web 110. Therefore, the drying device 300 includes the guide roller 22A instead of the heating roller 11D.

Thus, the drying device 300 includes the guide roller 22A to contact the web 110 twice from different directions. The plurality of heating rollers 11A to 11G includes two heating rollers 11C and 11E. The guide roller 22A is between the two heating rollers 11C and 11E in the conveyance path.

In a second example illustrated in FIG. 12B, the drying device 300 includes guide rollers 22A, 22B, and 22C instead of the heating rollers 11D, 11B, and 11F, and includes a guide roller 22D instead of the heating roller 12. In the second example in FIG. 12B, the drying device 300 includes two heating drums 13A and 13B in the folding path 10.

Thus, the drying device 300 includes the guide roller 22B to contact the web 110 twice from different directions. The plurality of heating rollers 11A to 11G includes two heating rollers 11A and 11C. The guide roller 22B is between the two heating rollers 11A and 11C in the conveyance path. Further, the drying device 300 includes the guide roller 22C to contact the web 110 twice from different directions. The plurality of heating rollers 11A to 11G includes two heating rollers 11E and 11G. The guide roller 22C is between the two heating rollers 11E and 11G in the conveyance path.

The drying device 300 in the second example in FIG. 12B reduces a number of heating rollers 11 and 12 so that the drying device 300 can reduce a cost while preventing a decrease in a drying performance of the drying device 300.

Figure 13:
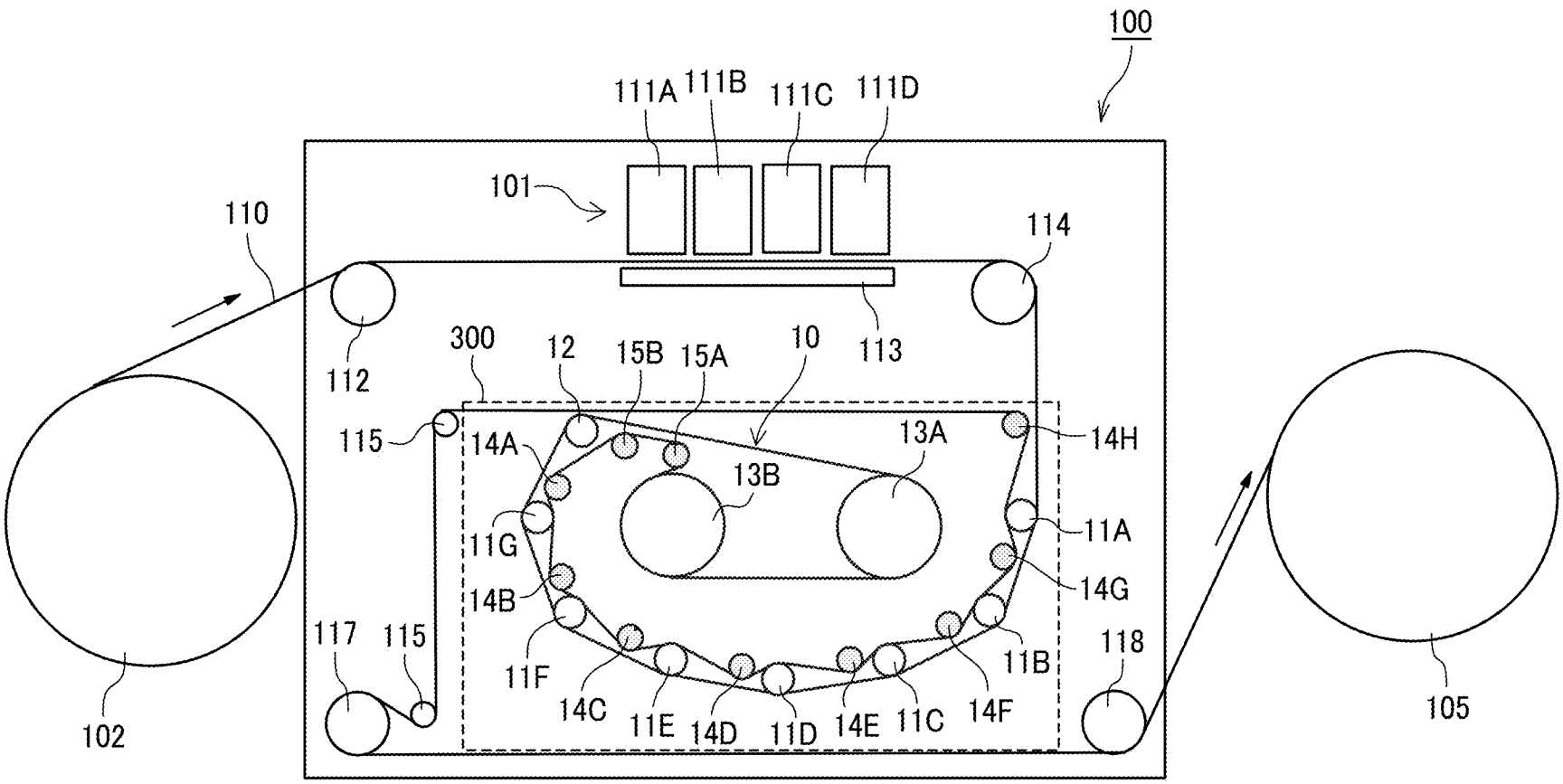
FIG. 13 is a schematic cross-sectional front view of a printer according to a ninth embodiment of the present disclosure.

Next, a printer 100 according to a ninth embodiment of the present disclosure is described with reference to FIG. 13. FIG. 13 is a schematic cross-sectional front view of the printer 100 according to the ninth embodiment of the present disclosure.

The printer 100 conveys the web 110 fed from the feeding roller 102 by the conveyance roller 112, guides the web 110 to a position facing the heads 111A to 111D of the liquid application device 101 by the conveyance guide 113 while discharging the liquids from the heads 111A to 111D onto the web 110.

Then, the drying device 300 according to the first embodiment dries the web 110 fed from the guide roller 114, and the plurality of guide rollers 115 guides the web 110 to the cooling roller 117 to be cooled by the cooling roller 117. The web 110 then wound on the winding roller 105.

The printer 100 includes the drying device 300 according the first embodiment so that the printer 100 can reduce a height of the printer 100. Further, the printer 100 decreases heat of the web 110 during traveling on a path from the heating roller 11A to the guide roller 115 and then cools the web 110 by the cooling roller 117, so that the printer 100 can further efficiently cools the web 110. The printer 100 includes the liquid application device 101 above the drying device 300 can reduce a length of the printer 100 in a lateral (horizontal) direction in FIG. 13.

Figure 14:
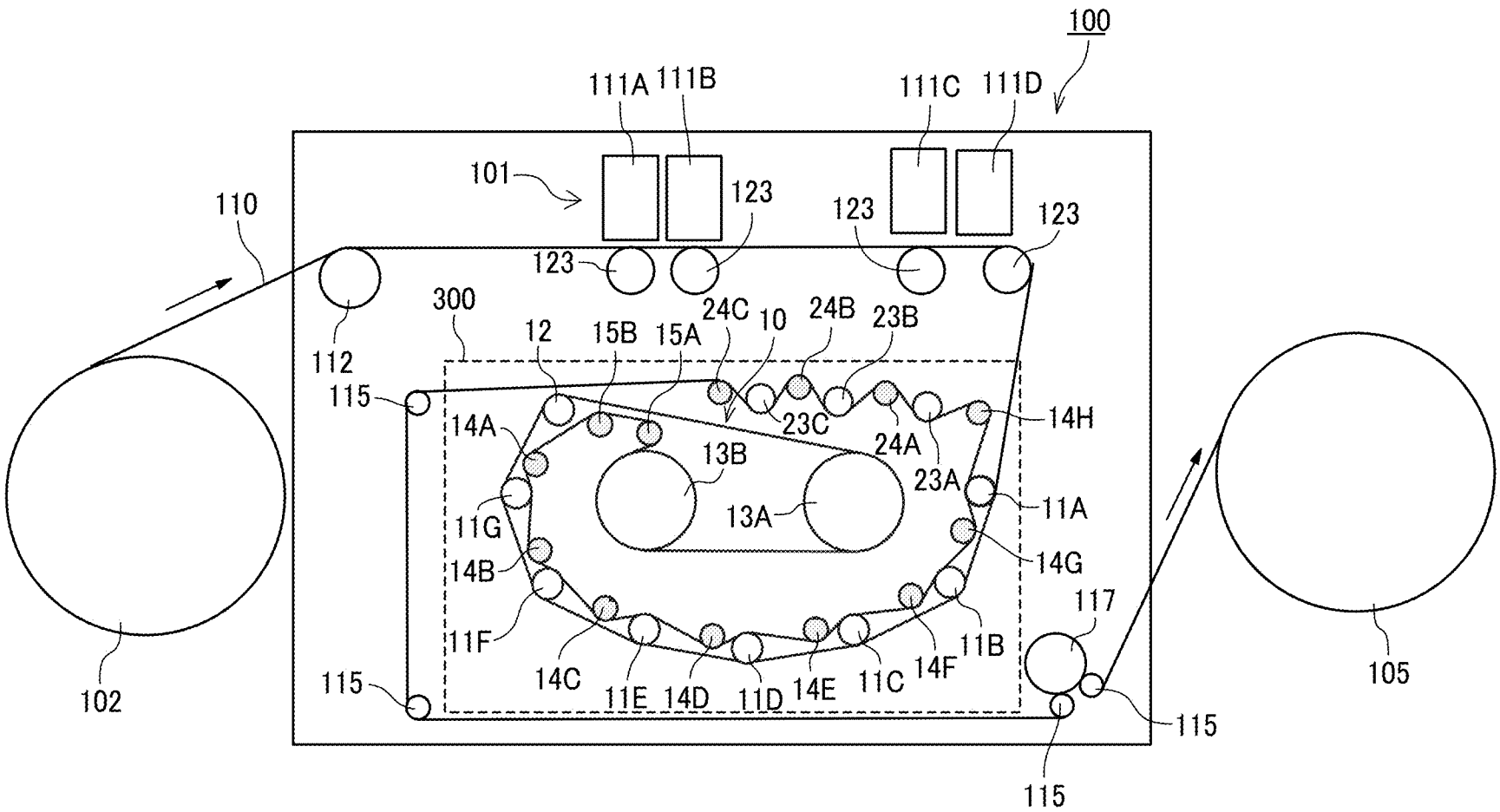
FIG. 14 is a schematic cross-sectional front view of a printer according to a tenth embodiment of the present disclosure.

Next, a printer 100 according to a tenth embodiment of the present disclosure is described with reference to FIG. 14. FIG. 14 is a schematic cross-sectional front view of the printer 100 according to the tenth embodiment of the present disclosure.

The printer 100 conveys the web 110 fed from the feeding roller 102 by the conveyance roller 112 and guides the web 110 by facing rollers 123 to face the heads 111A to 111D of the liquid application device 101 while the heads 111 apply the liquid onto the web 110 to print an image on the web 110.

Then, a drying device 300 according to the tenth embodiment dries the web 110 fed from the facing roller 123, and the plurality of guide rollers 115 guides the web 110 to the cooling roller 117 to be cooled by the cooling roller 117. The web 110 then wound on the winding roller 105.

The liquid application device 101 includes a first group of the heads 111A and 111B and a second group of the heads 111C and 111D divided from the first group of the heads 111A and 111B. The printer 100 includes the cooling roller 117 near an exit of the printer 100.

Further, the drying device 300 includes heating rollers 23A to 23C and guide rollers 24A to 24C alternately arranged with the heating rollers 23A to 23C, respectively, on a downstream side of the guide roller 14H in addition to the configuration of the first embodiment to increase the drying performance of the drying device 300.

The guide roller 14H is disposed at the most downstream side of a conveyance path in the conveyance direction indicated by arrow in FIG. 14 among the guide rollers 14 that press the web 110 against the heating rollers 11. The drying device 300 includes the heating rollers 23A to 23C and the guide rollers 24A to 24C above an oblique conveyance path from the heating drum 13A to the heating roller 12 to reduce a space in a height (vertical) direction of the drying device 300.

Thus, the drying device 300 includes a plurality of third-heating rotators (heating rollers 23A to 23C) and the guide rollers 24A to 24C alternately contact one surface and another surface of the web 110 after the one surface of the web 110 contacts and passes the at least three second-heating rotators (heating roller 12 and heating drums 13A and 13B) and the first-heating rotator (heating rollers 11).

Figure 15:
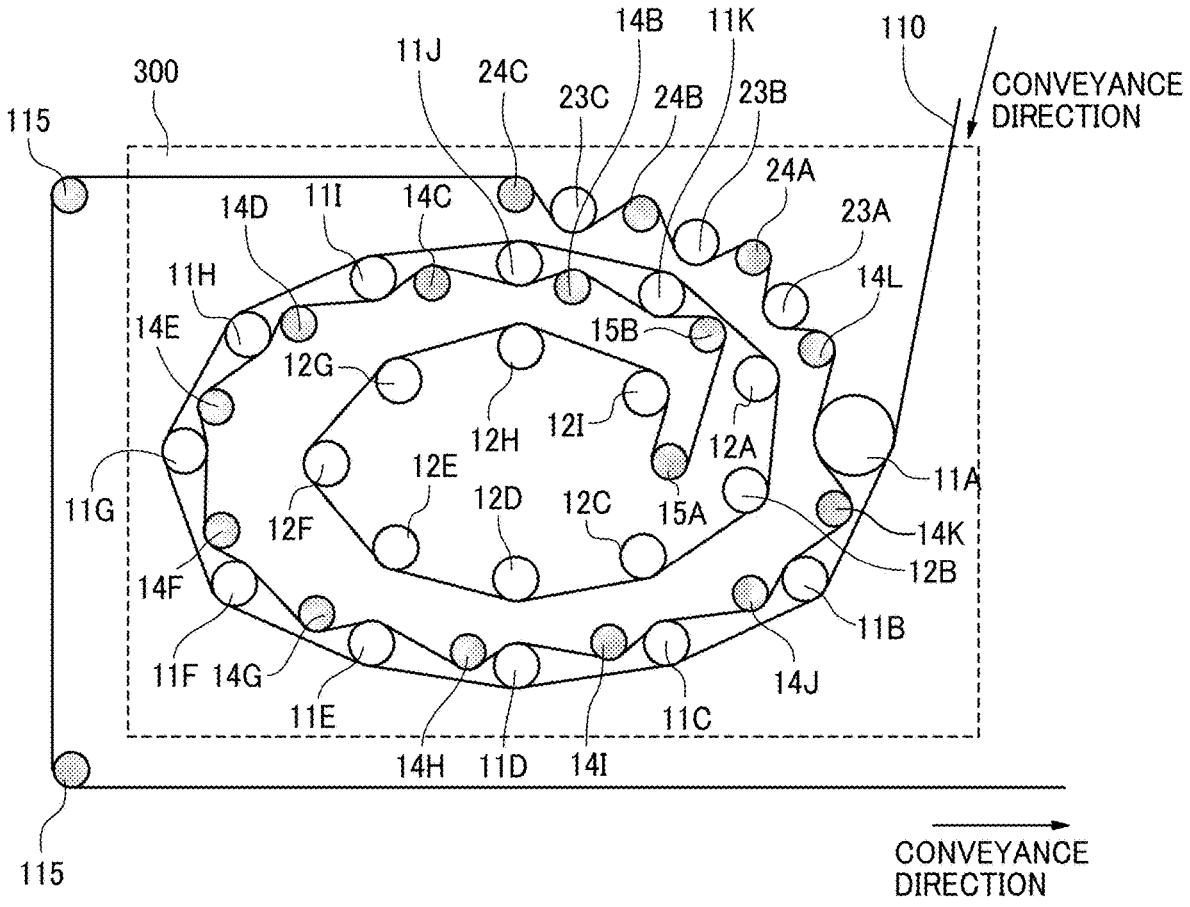
FIG. 15 is a schematic cross-sectional front view of a drying device according to an eleventh embodiment of the present disclosure.

Next, a drying device 300 according to an eleventh embodiment of the present disclosure is described with reference to FIG. 15. FIG. 15 is a schematic cross-sectional front view of the drying device 300 according to the eleventh embodiment of the present disclosure.

The drying device 300 according to the eleventh embodiment includes heating rollers 11A to 11K contacting the web 110 twice, heating rollers 12A to 121 contacting the web 110 once at the folding path 10, guide rollers 14A to 14K that press the web 110 against the heating rollers 11A to 11K, and a guide roller 15A at the folding path 10.

The heating roller 11A is positioned on the most upstream side of the conveyance path among the heating rollers 11A to 11K. The heating roller 11A has a larger diameter than other heating rollers 11 so that the heating roller 11A can initially apply a large heat quantity to the web 110. Further, the heating roller 11A has a larger diameter than the other heating rollers 11 to form a gentle sloped path from the guide roller 14K to the guide roller 14L.

Similar to the tenth embodiment, the drying device 300 in the eleventh embodiment includes alternately arranged heating rollers 23A to 23C and guide rollers 24A to 24C on the downstream side of the guide roller 14L to increase a drying capacity. The guide roller 14L is disposed at the most downstream side of the conveyance path among the guide rollers 14 that press the web 110 against the heating rollers 11. The drying device 300 includes the heating rollers 23A to 23C and the guide rollers 24A to 24C above an oblique conveyance path from heating roller 12A to the heating roller 11J to reduce a space in a height (vertical) direction of the drying device 300.

Figure 16:
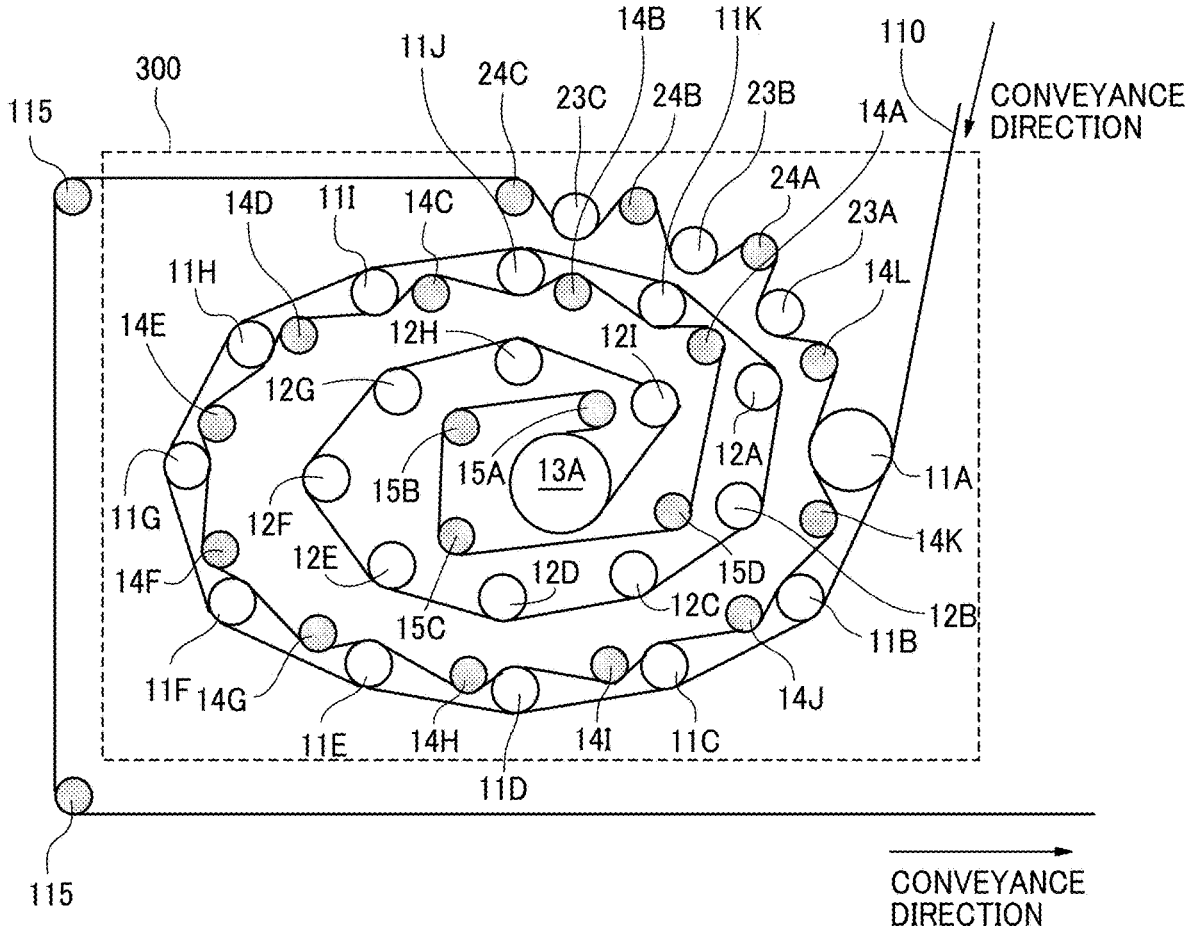
FIG. 16 is a schematic cross-sectional front view of a drying device according to a twelfth embodiment of the present disclosure.

Next, a drying device 300 according to a twelfth embodiment of the present disclosure is described with reference to FIG. 16. FIG. 16 is a schematic cross-sectional front view of the drying device 300 according to the twelfth embodiment of the present disclosure.

The drying device 300 according to the twelfth embodiment includes a heating drum 13A on a downstream side of the heating roller 121 in the folding path 10 in the conveyance direction indicated by arrow in FIG. 16 and guide rollers 15A to 15D between the guide roller 14A and the heating drum 13A in the configuration of the drying device 300 in the eleventh embodiment.

The drying device 300 in the twelfth embodiment has a larger winding angle with the heating rollers 11 than the drying device 300 in the eleventh embodiment, so that the drying device 300 in the twelfth embodiment has a relatively higher overall height than the drying device 300 in the eleventh embodiment.

Thus, the drying device 300 can heat the web 110 by the heating drum 13A and further has higher drying capacity than the drying capacity of the drying device 300 in the tenth embodiment.

Figure 17:
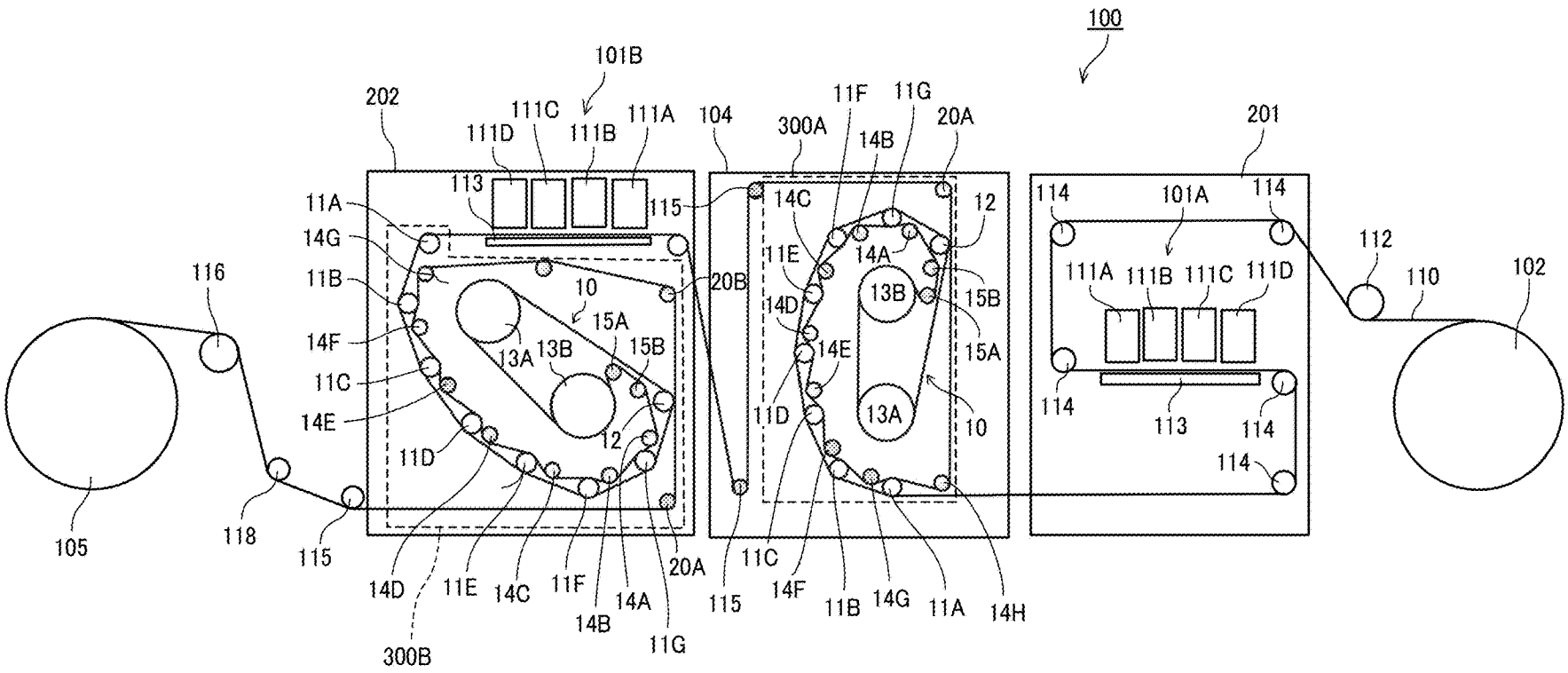
FIG. 17 is a schematic cross-sectional front view of a printer according to a thirteenth embodiment of the present disclosure.

Next, a printer 100 according to a thirteenth embodiment of the present disclosure is described with reference to FIG. 17. FIG. 17 is a schematic cross-sectional front view of the printer 100 according to the thirteenth embodiment of the present disclosure.

The printer 100 includes a printing part 201, a dryer 104, and a print dryer 202 that performs printing and drying.

Then, the printer 100 conveys the web 110 fed from the feeding roller 102 to the printing part 201 by the conveyance roller 112. The printing part 201 guides the web 110 to a position facing the heads 111A to 111D of the liquid application device 101A by the plurality of guide rollers 114 and the conveyance guide 113 so that the printing part 201 applies the liquid from the heads 111A to 111D onto the web 110 to print an image on the web 110 (perform printing).

Then, the web 110 is sent to the dryer 104 by the guide rollers 114 with a liquid application surface (second surface) of the web 110 facing downward. The liquid application surface is a surface of the web 110 onto which the liquid has been applied by the heads 111. A drying device 300A according to the thirteenth embodiment dries the web 110 while the web 110 passes the drying device 300A, and the plurality of guide rollers 115 guides and feeds the web 110 to the print dryer 202.

The web 110 sent to the print dryer 202 is guided to face the heads 111A to 111D of the liquid application device 101B on the downstream side while an opposite surface (first surface) of the web 110 opposite to the liquid application surface (second surface) faces upward. The liquid is not applied to the first surface (opposite surface) of the web 110. The heads 111A to 111D of the liquid application device 101B apply the liquid to the first surface of the web 110 to print the image on the first surface of the web 110 (perform printing).

Then, the web 110 enters a drying device 300B downstream of the heads 111A to 111D in the conveyance direction while the first surface of the web 110 faces outside the conveyance path. The drying device 300B dries the first surface of the web 110, and an ejection roller 116 sends the web 110 fed from the guide roller 118 to the winding roller 105 to be wound around the winding roller 105.

The drying device 300A on an upstream side of the drying device 300B in the conveyance direction in the thirteenth embodiment has a similar configuration with the fifth embodiment as illustrated in FIG. 9 in which the heating drums 13A and 13B are arrayed in the vertical direction. However, an arrangement of the heating drums 13A and 13B are opposite of an arrangement of the heating drums 13A and 13B in the fifth embodiment. Thus, the printer 100 according to the thirteenth embodiment can reduce a length of the printer 100 as a whole.

The drying device 300B on the downstream side includes the heating drums 13A and 13B arranged obliquely at an angle to the horizontal direction as in the drying device 300 in the sixth embodiment in FIG. 10. The plurality of heating rollers 11A to 11G is arranged in a substantially elliptic arc shape around the heating drums 13A and 13B. The printer 100 includes the liquid application device 101B above the drying device 300B. Thus, the printer 100 according to the thirteenth embodiment can reduce a length of the printer 100 as a whole.

Figure 18:
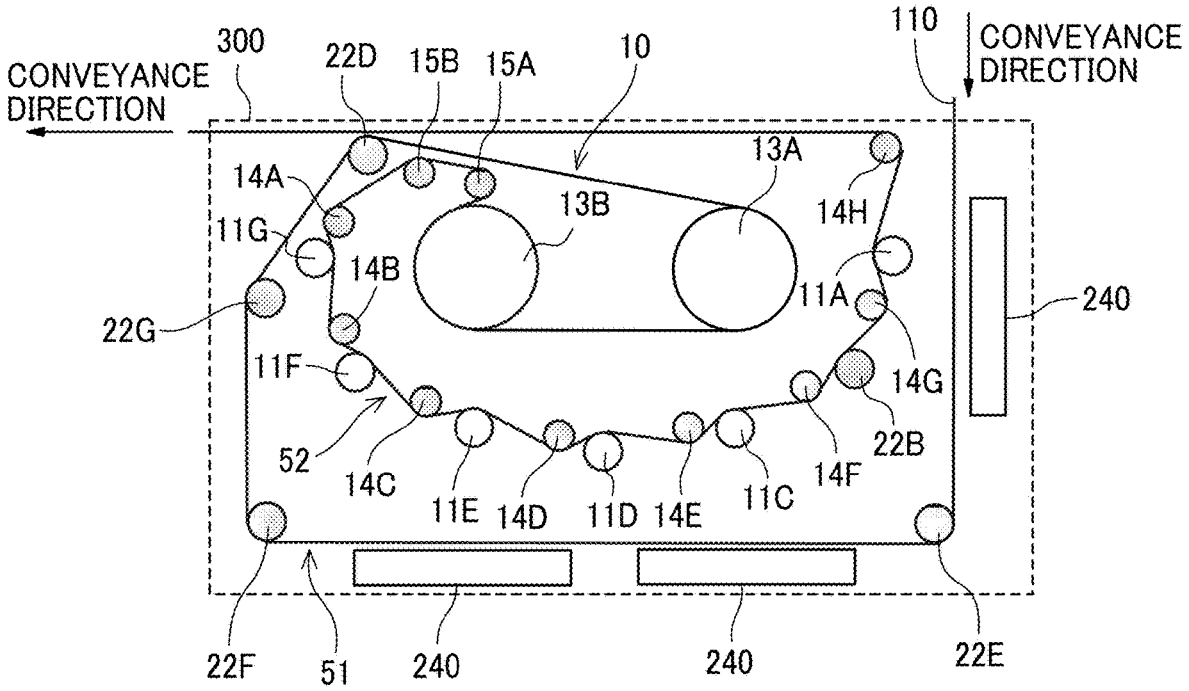
FIG. 18 is a schematic cross-sectional front view of a drying device according to a fourteenth embodiment of the present disclosure.

Next, a drying device 300 according to a fourteenth embodiment of the present disclosure is described with reference to FIG. 18. FIG. 18 is a schematic cross-sectional front view of the drying device 300 according to the fourteenth embodiment of the present disclosure.

The drying device 300 according to fourteenth embodiment includes the heating rollers 11 (11A to 11G) in the eighth embodiment (see FIGS. 12A and 12B) that contact the web 110 only in a conveyance path of the web 110 on a downstream side of the heating drum 13B. The conveyance path on the downstream side of the heating drum 13B is referred to as the "folding path 52."

The drying device 300 includes guide rollers 22E, 22F, and 22G in a conveyance path (also referred to as the "first path 51") from an inlet (see left top in FIG. 18) of the conveyance path to the guide roller 22D of the drying device 300. The web 110 is wound around the conveyance path formed by the guide rollers 22E, 22F, and 22G. Further, the drying device 300 includes a heater 240 serving as a first heater to heat the liquid application surface of the web 110 without contacting the liquid application surface of the web 110 (noncontact heating). An infrared heater, a halogen heater, or the like can be applied as the heater 240.

The drying device 300 dries the liquid application surface (second surface) of the web 110 with the heater 240 and heats the opposite surface (first surface) of the web 110 with the heating drums 13A and 13B and the heating rollers 11 (11A to 11G) pressed against the web 110 by the guide rollers 14 in the folding path 52. The first surface (opposite surface) is opposite to the second surface (liquid application surface) of the web 110.

Here, the folding path 52 is a path that guides the web 110 by the guide rollers 14 so that the web 110 that has passed the heating drums 13A and 13B as the second-heating rotators contacts the heating rollers 11 (11A to 11G) as the first-heating rotators. Thus, the drying device 300 includes the heating drums 13A and 13B that serve as two second-heating rotators inside the folding path 52.

Thus, the drying device 300 includes the folding path 52 outside the heating drums 13A and 13B and the first path 51 outside the folding path 52.

Thus, the drying device 300 can reduce a space of the drying device 300 while ensuring required drying property of the drying device 300. The first path 51 in the fourteenth embodiment can be applied to other embodiments.

Figure 19:
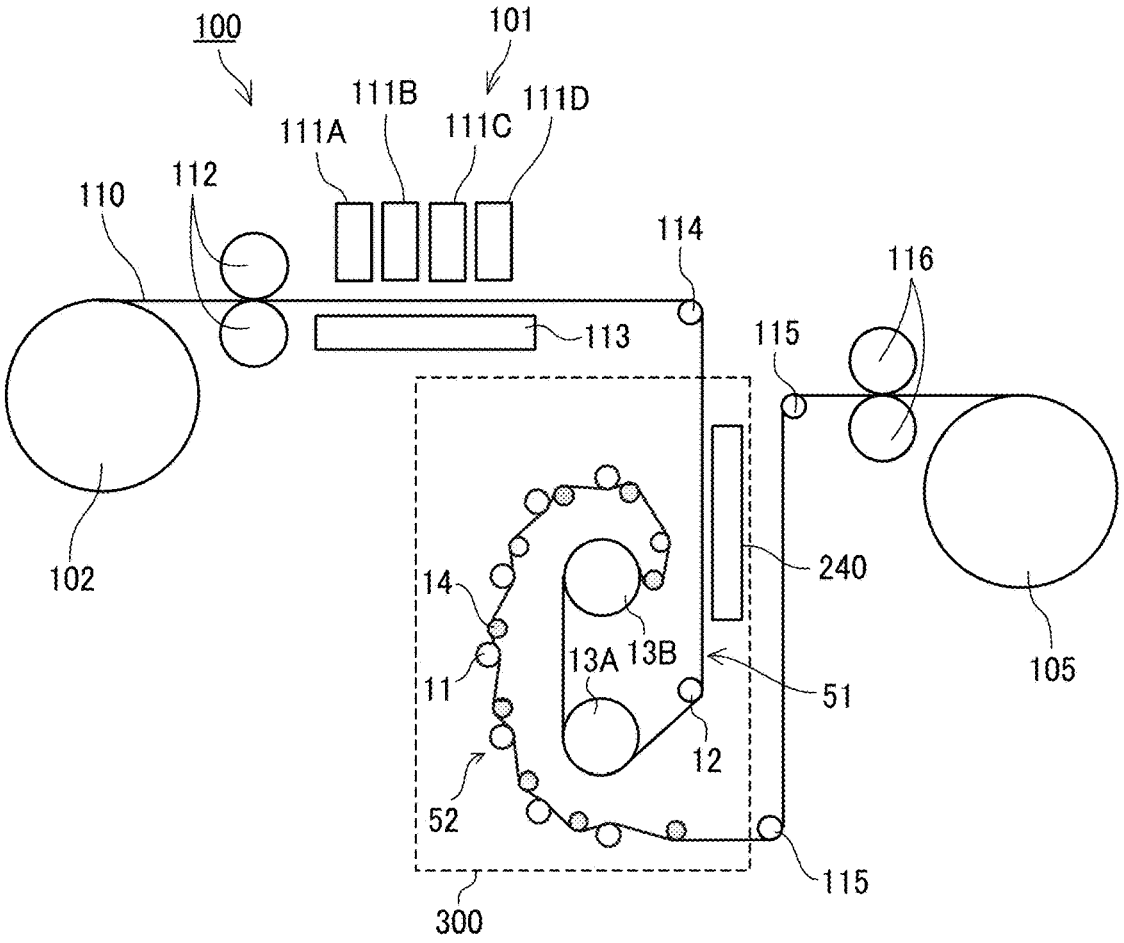
FIG. 19 is a schematic cross-sectional front view of a printer according to a fifteenth embodiment of the present disclosure.

Next, a printer 100 according to a fifteenth embodiment of the present disclosure is described with reference to FIG. 19. FIG. 19 is a schematic cross-sectional front view of the printer 100 according to the fifteenth embodiment of the present disclosure.

The drying device 300 in the fifteenth embodiment includes the first path 51 in the fourteenth embodiment (see FIG. 18) on an opposite side of the folding path 52 with the heating drums 13A and 13B interposed between the first path 51 and the folding path 52. Further, drying device 300 includes the heating rollers 12 in a downstream of the heater 240.

In FIG. 19, the folding path 52 is a guide path to guide the web 110, which has passed the heating drums 13A and 13B as the second-heating rotators, by the guide roller 14 so that the web 110 contacts the heating rollers 11 as the first-heating rotators. The drying device 300 includes the heating roller 12 and heating drums 13A and 13B serving as three numbers of the second-heating rotators inside the guiding path of the guide rollers 14.

The drying device 300 includes the folding path 52 outside the heating drums 13A and 13B to reduce a space of the drying device 300.

Figure 20:
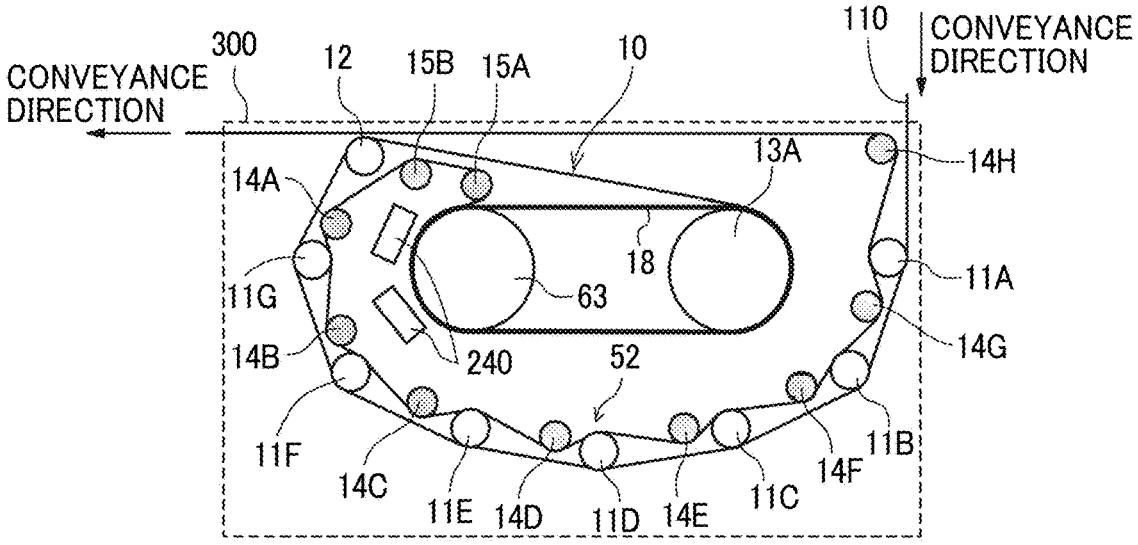
FIG. 20 is a schematic cross-sectional front view of a drying device according to a sixteenth embodiment of the present disclosure.

Next, a drying device 300 according to a sixteenth embodiment of the present disclosure is described with reference to FIG. 20. FIG. 20 is a schematic cross-sectional front view of the drying device 300 according to the sixteenth embodiment of the present disclosure.

The drying device 300 according to the sixteenth embodiment includes a belt 18 serving as the second-heating rotator. The belt 18 is wound around a heating drum 13A as a drive rotator and a driven drum 63 as a driven rotator. Further, the drying device 300 includes a heater 240 serving as a noncontact heater to heat the liquid application surface (second surface) of the web 110. The heater 240 faces the driven drum 63 side of the belt 18. An infrared heater, a halogen heater, or the like can be applied as the heater 240.

Thus, the heater 240 heats the liquid application surface (second surface) of the web 110 so that the drying device 300 can prevent the liquid applied on the web 110 to be adhered to the guide roller 15A.

In FIG. 20, the folding path 52 is a guide path to guide the web 110, which has passed the belt 18 as the second-heating rotators, by the guide rollers 14 (14A to 14H) so that the web 110 contacts the heating rollers 11 (11A to 11G) as the first-heating rotators. Thus, the drying device 300 includes the belt 18 inside the folding path 52 as the guide path.

Figure 21:
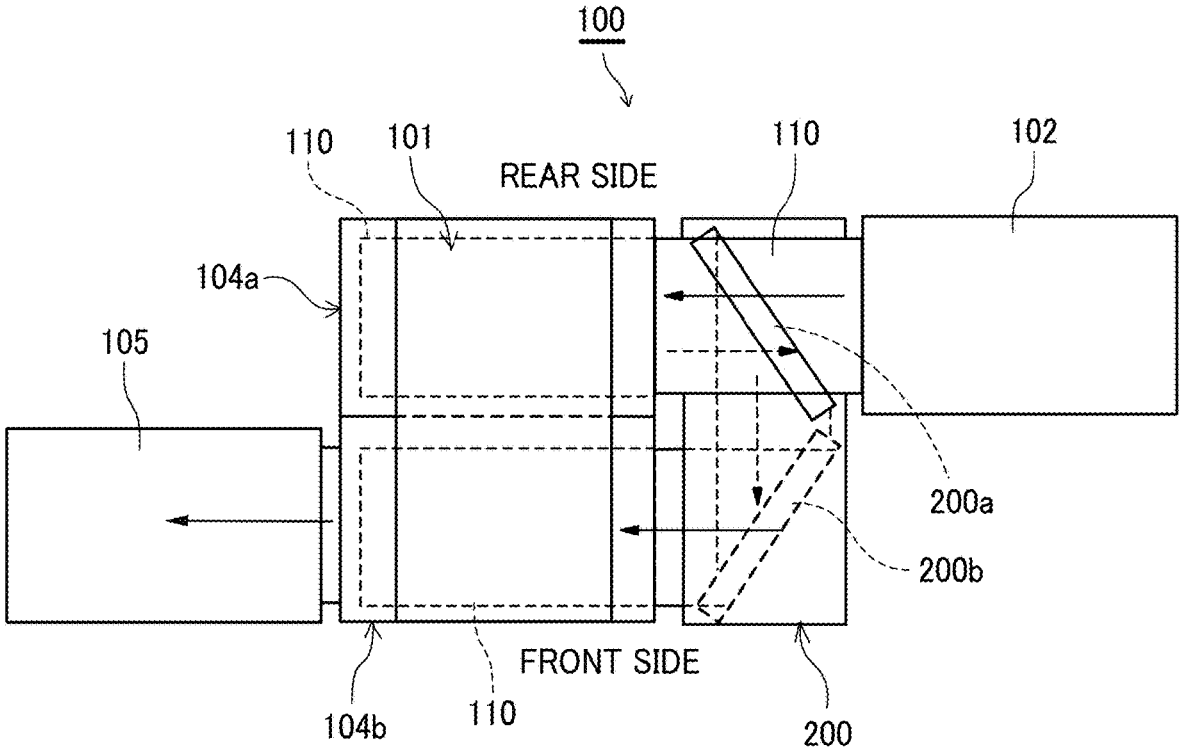
FIG. 21 is a schematic plan view of a printer according to a seventeenth embodiment of the present disclosure.
Figure 22:
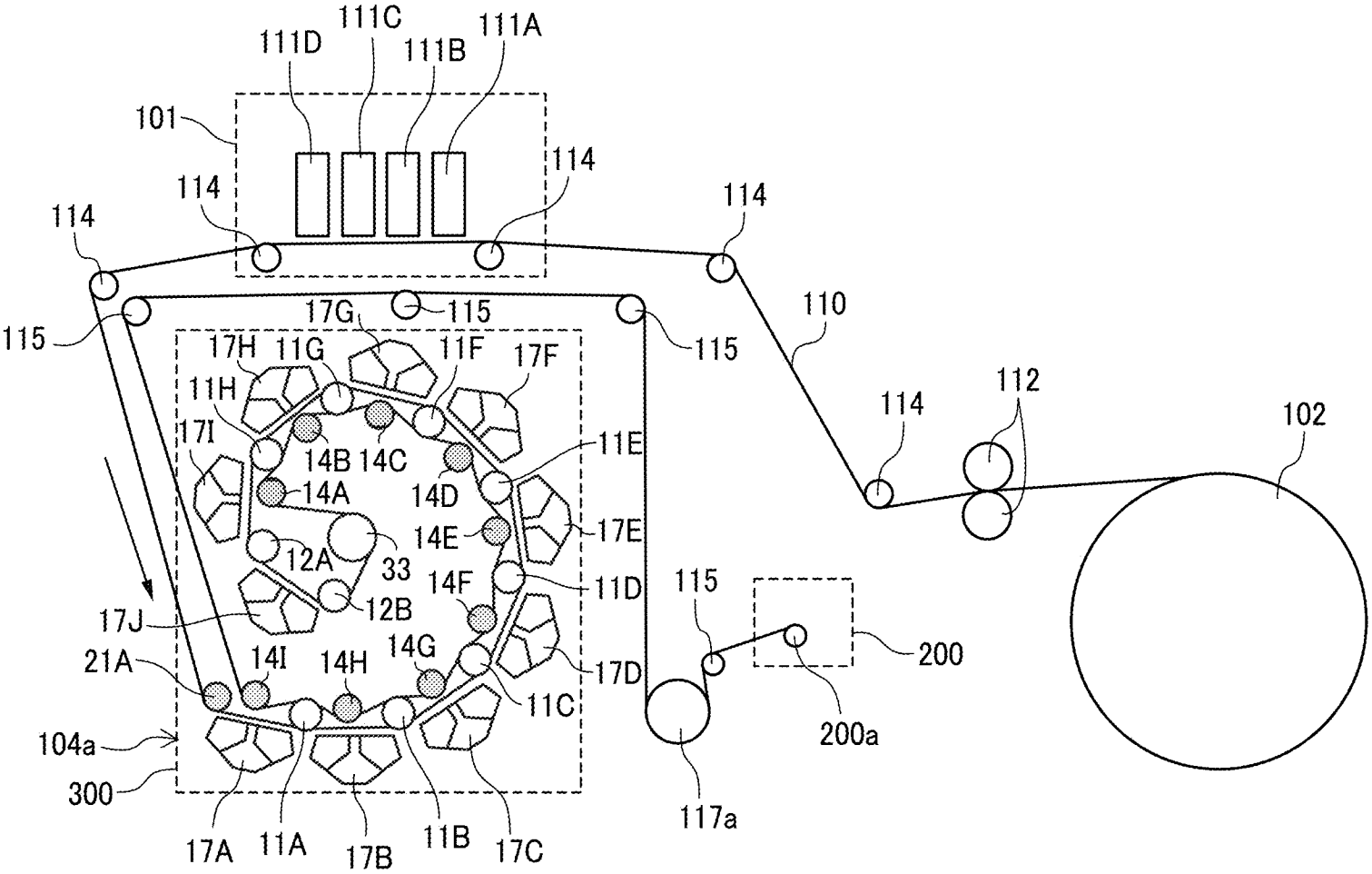
FIG. 22 is a schematic cross-sectional front view of a printer from a feeding roller to a reversing part according to a seventeenth embodiment of the present disclosure.
Figure 23:
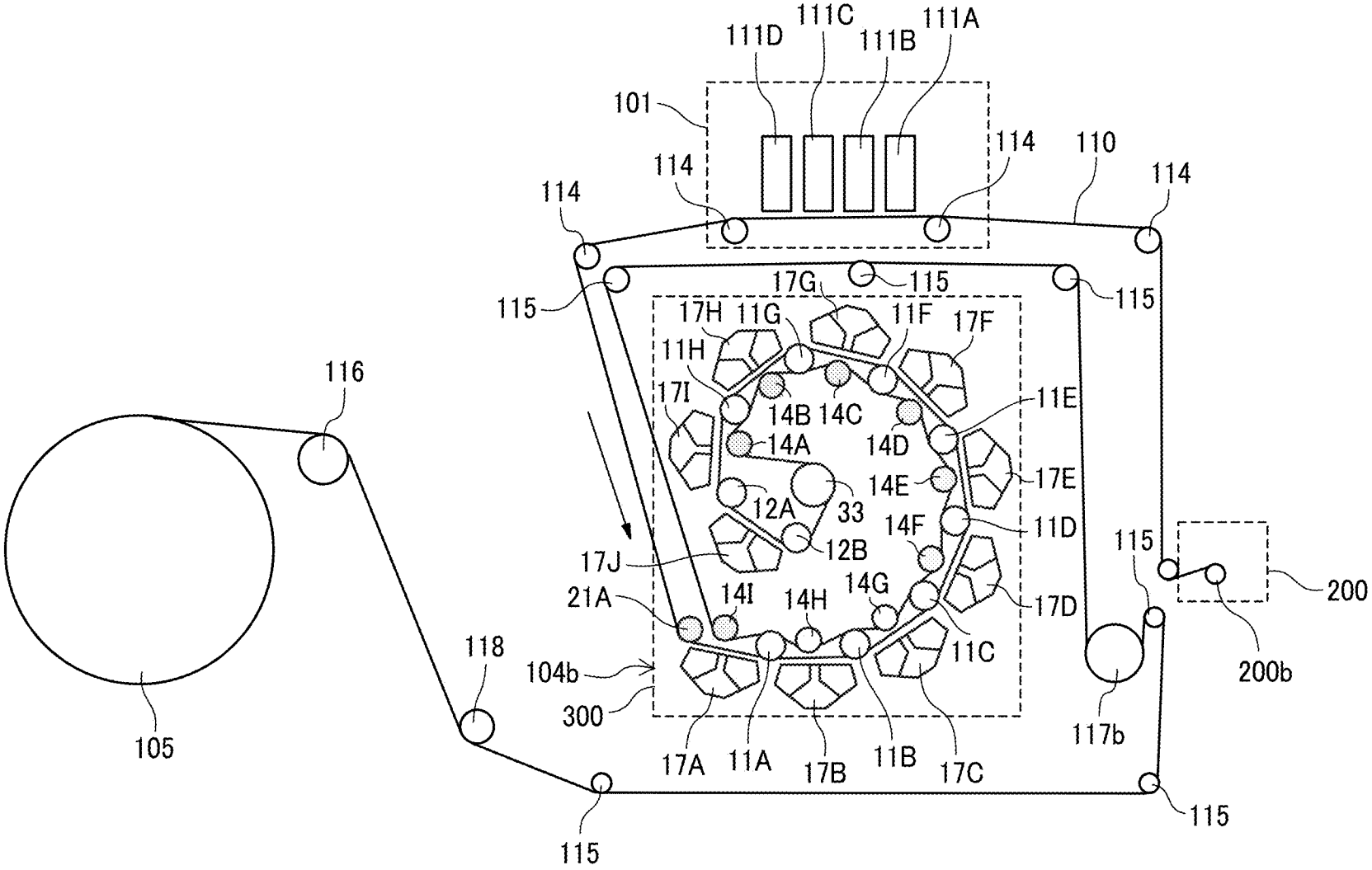
FIG. 23 is a schematic cross-sectional front view of a printer from the reversing part to a second dryer according to a seventeenth embodiment of the present disclosure.

Next, a printer 100 according to a seventeenth embodiment of the present disclosure is described with reference to FIGS. 21 to 23. FIG. 21 is a plan view of the printer 100 according to the seventeenth embodiment of the present disclosure. FIG. 22 is a schematic cross-sectional front view of the printer 100 from the feeding roller 102 to a reversing part 200. FIG. 23 is a schematic cross-sectional front view of the printer 100 from the reversing part 200 to the second dryer 104*b*.

The printer 100 includes a feeding roller 102, a liquid application device 101, a first dryer 104*a* (upstream dryer), a reversing part 200 (direction changer), a second dryer 104*b* (downstream dryer), and a winding roller 105.

The printer 100 conveys the web 110 fed from the feeding roller 102 by the conveyance roller 112 and applies the liquid onto a first surface of the web 110 by the heads 111A to 111D at a position facing the head 111 of the liquid application device 101 as illustrated in FIG. 22 to print an image on the first surface of the web 110 (perform printing).

Then, the web 110 passes the guide roller 114 and the first dryer 104*a* including the drying device 300 according to the seventeenth embodiment to be dried. The web 110 is then cooled by the cooling roller 117*a*. Then, the web 110 is reversed by the reversing part 200 by 90 degrees so that the web 110 is reversed upside down and is bent again by 90 degrees to be conveyed to the liquid application device 101. Next, the heads 111A to 111D apply the liquid onto the second surface (liquid application surface) of the web 110 at the position facing the head 111 of the liquid application device 101 as illustrated in FIG. 23 to print an image on a second surface of the web 110.

Then, the web 110 is dried by the second dryer 104*b* including the drying device 300 according to the seventeenth embodiment, is cooled by the cooling roller 117*b*, and is then wound by the winding roller 105.

Thus, the reversing part 200 changes a conveyance direction of the web 110 while reversing a first surface and a second surface opposite to the first surface of the web 110 upside down between the first dryer 104*a* and the second dryer 104*b*. The first dryer 104*a* and the second dryer 104*b* are parallel with each other.

As illustrated in FIG. 21, processes from the feeding roller 102 to a printing and a drying of the first surface of the web 110 are arranged on a rear side (upper side in FIG. 21) of the printer 100. Further, processes from a printing of the second surface of the web 110 to the winding roller 105 are arranged on a front side (lower side in FIG. 21) of the printer 100.

The liquid application device 101 includes one head device (discharge device) that prints the first surface and the second surface of the web 110. The liquid application device 101 is disposed across a front side to a rear side of the printer 100 (see FIG. 12).

The reversing part 200 is located below a conveyance path of the web 110 from the conveyance roller 112 to the liquid application device 101 (see FIG. 22). Further, the reversing part 200 is located laterally next to (right-side in FIG. 21) the first dryer 104*a* and the second dryer 104*b*. The reversing part 200 includes a reversing roller 200*a* and a reversing roller 200*b* that are positioned obliquely with respect to the conveyance direction of the web 110.

The reversing roller 200*a* reverses the first surface of the web 110 that faces downward to face upward and changes the conveyance direction of the web 110 conveyed in a direction from left to right in FIGS. 21 and 22 to a direction from the rear side to the front side (see FIG. 21) of the printer 100 to guide the web 110.

The reversing roller 200*b* reverses the second surface of the web 110 that faces downward to face upward and changes the conveyance direction of the web 110 conveyed in a direction from the rear side to the front side (see FIG. 21) to a direction from right to left (see FIG. 23) of the printer 100 to guide the web 110.

Thus, the printer 100 can reduce a width from the feeding roller 102 to the winding roller 105 of the printer 100.

The first dryer 104*a* and the second dryer 104*b* have the same configuration. Each of the first dryer 104*a* and the second dryer 104*b* includes the heating rollers 11 (11A to 11I), the heating rollers 12 (12A and 12B), a heating roller 33, the guide rollers 14 (14A to 14I), the guide roller 21A, and the blowers 17 (17A to 17J).

The drying device 300 includes heating rollers 12A and 12B, and the heating roller 33 serving as three numbers of the second-heating rotators, and one guide roller 14A in a path from the heating roller 11H to the guide roller 14A.

The heating roller 33 has a larger diameter than each of the heating rollers 12A and 12B. A contact distance between the heating roller 33 and the web 110 is longer than a contact distance between the heating roller 12A and the web 110. Also, the contact distance between the heating roller 33 and the web 110 is longer than a contact distance between the heating roller 12B and the web 110. The heating roller 33 is positioned such that a distance from a center of the heating roller 33 to a center of the heating roller 11G is different from a distance from the center of the heating roller 33 to a center of the heating roller 11D.

Further, a width (length) in a left to right direction (horizontal direction) in the outer circumference path from the heating roller 11H to the heating roller 12A is smaller than a height in the vertical direction (see FIGS. 22 and 23). An outer circumference path from the heating roller 11A to the heating roller 12A has an elliptic arc shape.

Thus, the at least three second-heating rotators include a last second-heating rotator (heating roller 33) to contact a portion of the sheet last, and a first second-heating rotator (heating roller 12A) to contact the portion of the sheet first. The last second-heating rotator (heating roller 33) has a larger diameter than the first second-heating rotator (heating roller 12A).

Thus, the drying device 300 can reduce a size of the dryer 104 (the first dryer 104*a* and the second dryer 104*b*) in a width direction of the printer 100.

Further, the heating roller 33 and the heating roller 12B are located inside the outer circumference path from the heating roller 11A to the heating roller 12A. Further, a winding angle of the web 110 to the heating roller 33 is less than 180 degree. An inner circumference path from the heating roller 11H to the heating roller 11A faces the outer circumference path from the heating roller 12A to the guide roller 14A.

The heating roller 33 may have the same diameter as the heating roller 12B. The heating roller 12A and the heating roller 12B have the same diameter. However, the diameter of the heating roller 12B may be larger than the diameter of the heating roller 12A. Further, the diameter of the heating roller 12B may be the same as the diameter of the heating roller 33.

Further, the drying device 300 includes the blower 17 between adjacent heating rollers 11, between the heating rollers 11H and 12A, and between the heating rollers 12A and 12B.

Figure 24:
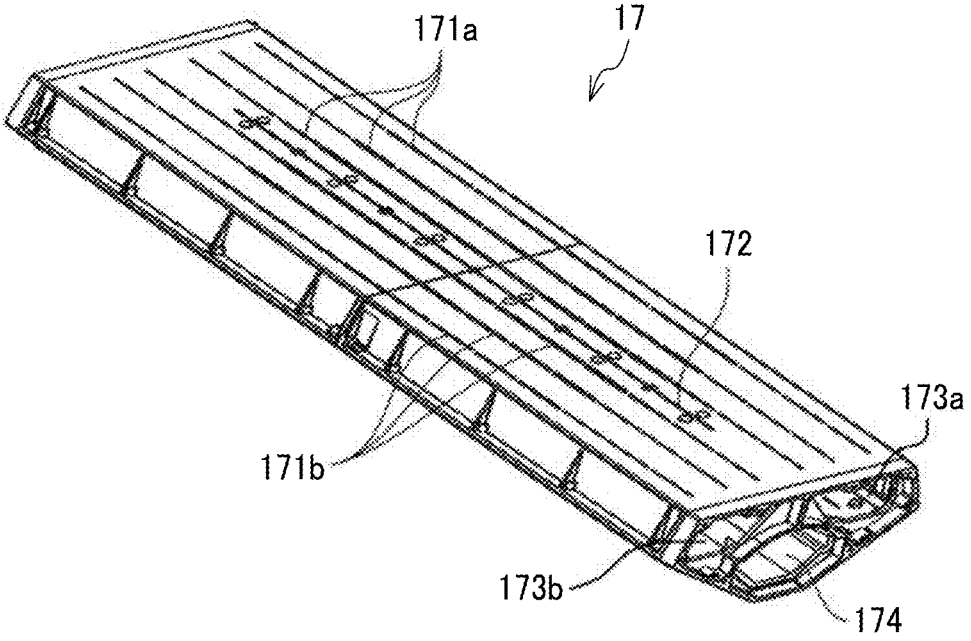
FIG. 24 is a schematic perspective view of a blower according to above-described embodiments of the present disclosure.

Next, an example of the blower 17 in the seventeenth embodiment of the present disclosure is described with reference to FIG. 24. FIG. 24 is a perspective view of the blower 17 according to the seventeenth embodiment of the present disclosure.

The blower 17 includes blower holes 172 facing the web 110, intake holes 171 (171*a* and 171*b*), and suction ducts 173 (173*a* and 173*b*). The blower holes 172 communicate with an air supply duct 174 and blow air toward the web 110. The intake hole 171*a* communicates with the suction duct 173*a*, and the intake hole 171*b* communicates with the suction duct 173*b*, respectively, to suck floating vapor. The blower 17 includes suction ducts 173 (173*a* and 173*b*) and an air supply duct 174 in a longitudinal direction of the blower 17.

Figure 25:
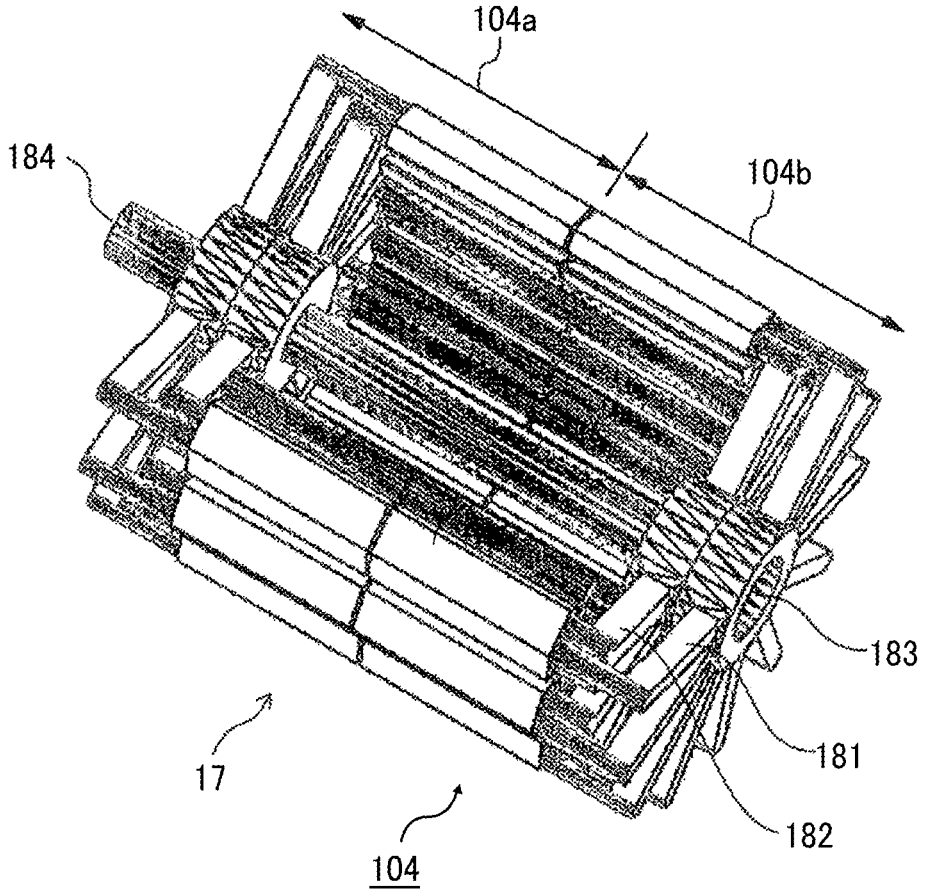
FIG. 25 is a schematic perspective view of a dryer of the printer illustrating a configuration of a connection between the blower and ducts from an apparatus body of the printer.
Figure 26:
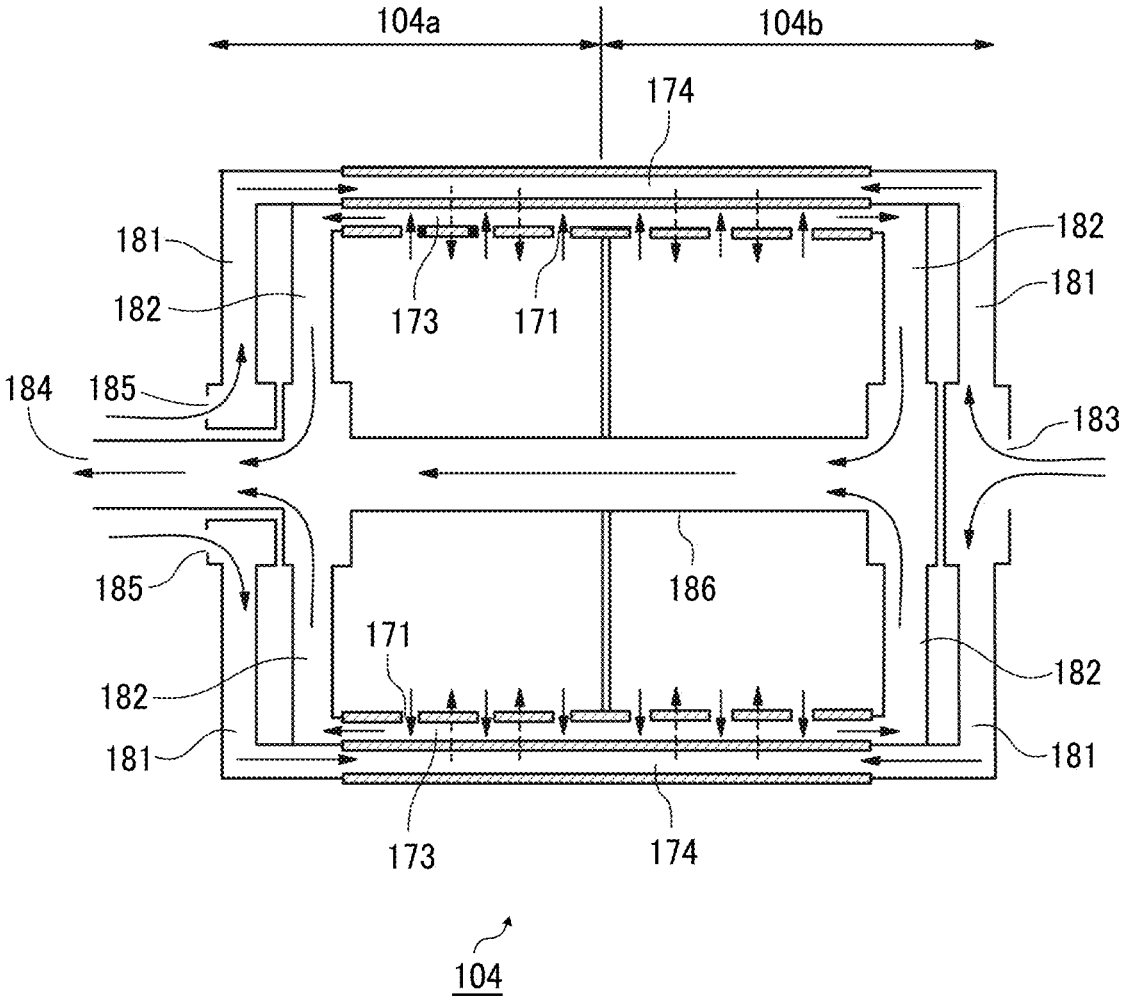
FIG. 26 is a schematic cross-sectional side view of the dryer illustrating the connection between the blower and the ducts.

Next, a configuration of a connection between the blower 17 and ducts (suction ducts 173, air supply ducts 174, and air exhaust duct 182) is described below with reference to FIGS. 25 and 26. FIG. 25 is a schematic perspective view of a dryer 104 of the printer 100 illustrating a configuration of a connection between the blower 17 and ducts from an apparatus body of the printer 100. FIG. 26 is a schematic cross-sectional side view of the dryer 104 illustrating the connection between the blower 17 and the ducts.

The blower 17 of the first dryer 104*a* and the blower 17 of the second dryer 104*b* are connected to each other in the longitudinal direction of the blower 17 (see FIG. 25). The blower 17 of the second dryer 104*b* is connected to the air supply duct 181 and the air exhaust duct 182 on the front side of the printer 100. The blower 17 of the first dryer 104*a* is connected to the air supply duct 181 and the air exhaust duct 182 on the rear side of the printer 100.

The air supply holes 183 are disposed on the front side (right side in FIG. 26) of the printer 100 and communicate with each of the air supply duct 181 that radially extend from the air supply holes 183. An airflow from each air supply duct 181 on the front side (right side in FIG. 26) of the printer 100 passes the air supply duct 174 and is blown from the blower holes 172 (see FIG. 24) toward the web 110.

Conversely, the airflow from each of intake holes 185 passes the air supply duct 181 on the rear side (left side in FIG. 26) of the printer 100, passes the air supply duct 174, and is blown from the blower holes 172 (see FIG. 24) toward the web 110.

An exhaust hole 184 is disposed on a rear side of the printer 100. The exhaust hole 184 communicates with each air exhaust duct 182 that extends radially from the exhaust hole 184. Floating vapor is sucked by the intake holes 171, passes the suction duct 173 and the air exhaust duct 182, and is exhausted through the exhaust holes 184 to the rear side of the printer 100 (see FIG. 26).

The airflow passing through each of the air exhaust duct 182 on the front side of the printer 100 is collected to a ducts 186 and discharged toward the exhaust hole 184 on the rear side of the printer 100.

A duct 186 is disposed inside a conveyance path of the web 110 (see FIGS. 22 and 23) from the heating roller 12B, the heating roller 33, and the heating roller 11H toward the heating roller 11A.

Thus, the blower 17 can dry the web 110 and appropriately adjust humidity environment inside the dryer 104 while preventing an increase in a size of the dryer 104.

To perform maintenance on the first dryer 104*a*, the first dryer 104*a* is accessible from the rear side of the printer 100. To perform maintenance on the second dryer 104*b*, the second dryer 104*b* is accessible from the front side of the printer 100.

The first dryer 104*a* and the second dryer 104*b* may be relatively separated in a front and rear direction. Then, the first dryer 104*a* and the second dryer 104*b* can be separated from a connecting between the blower 17 of the first dryer 104*a* and the blower 17 of the second dryer 104*b*. Further, the duct 186 as illustrated in FIG. 26 may be separable in the front and rear direction of the printer 100.

Figure 27:
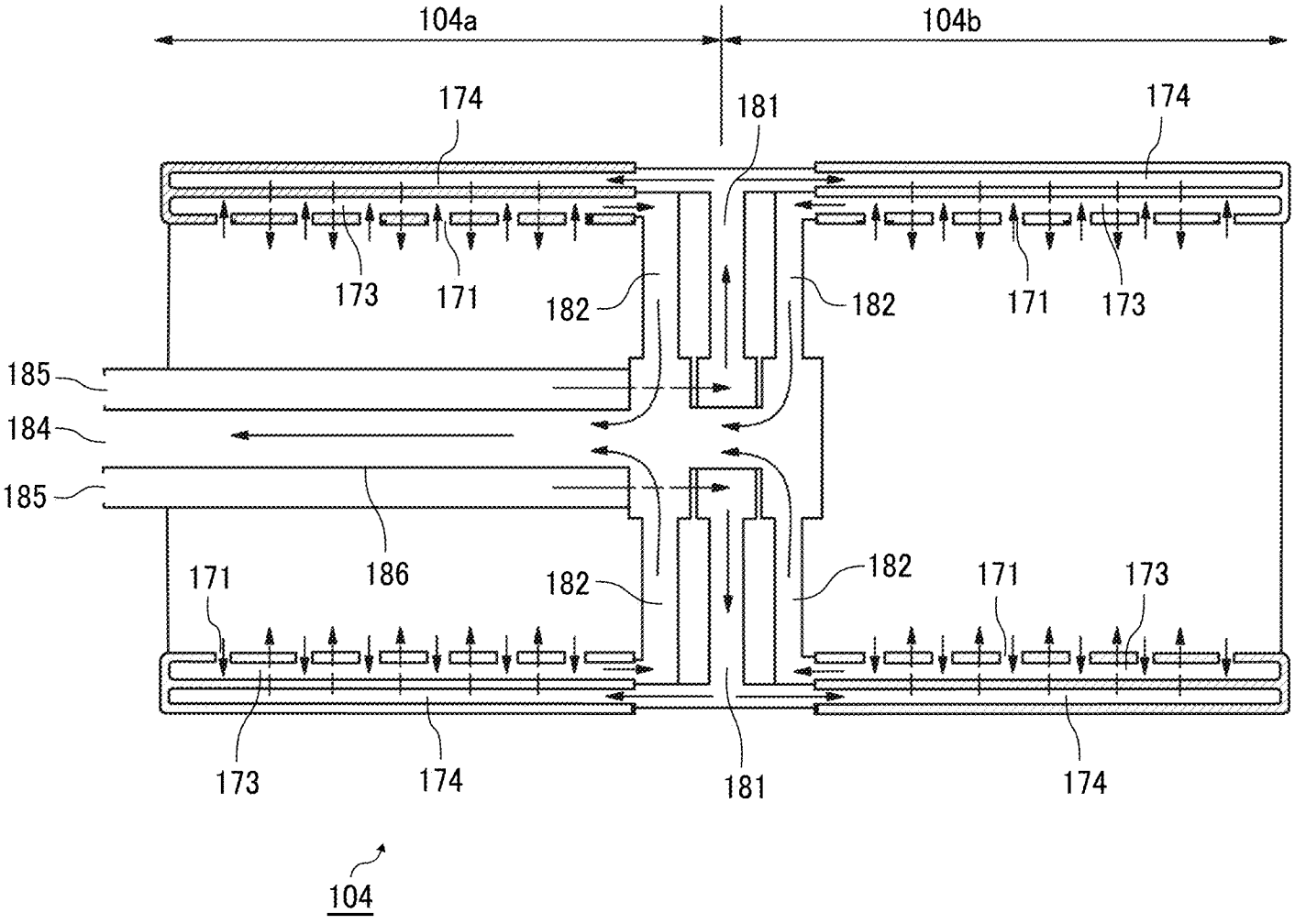
FIG. 27 is a schematic cross-sectional side view of a dryer of the printer illustrating a configuration of a connection between the blower and ducts from an apparatus body of the printer according to an eighteenth embodiment of the present disclosure.

Next, a dryer 104 of the printer 100 according to an eighteenth embodiment of the present disclosure is described with reference to FIG. 27. FIG. 27 is a schematic cross-sectional side view of the dryer 104 of the printer 100 according to the eighteenth embodiment of the present disclosure. FIG. 27 illustrates a configuration of a connection between the blower 17 and ducts from an apparatus body of the printer 100.

The dryer 104 according to the eighteenth embodiment distributes an airflow introduced from the intake hole 185 and passed through the air supply duct 181 to the blower 17 of the first dryer 104*a* on the rear side of the printer 100 and the blower 17 of the second dryer 104*b* on the front side of the printer 100. The intake hole 185 is disposed on the rear side of the printer 100.

Further, the vapor sucked from each of the blower 17 of the first dryer 104*a* on the rear side of the printer 100 and the blower 17 of the second dryer 104*b* on the front side of the printer 100 is collected to the duct 186 to be discharged to the rear side of the printer 100.

Thus, the dryer 104 in the eighteenth embodiment does not include a duct on the second dryer 104*b* side (on front side of the printer 100) unlike the seventeenth embodiment as illustrated in FIG. 26.

Thus, it becomes easier to access from the front side of the printer 100 to maintenance a space inside the conveyance path (see FIGS. 22 and 23) of the web 110 from the heating roller 12B, the heating roller 33, and the heating roller 11H toward the heating roller 11A. Thus, the drying device 300 can improve maintainability. Further, the air supply duct 181 is shared by the first dryer 104*a* and the second dryer 104*b*. Thus, the dryer can reduce a size of the printer 100 in the front and rear direction of the printer 100.

Figure 28:
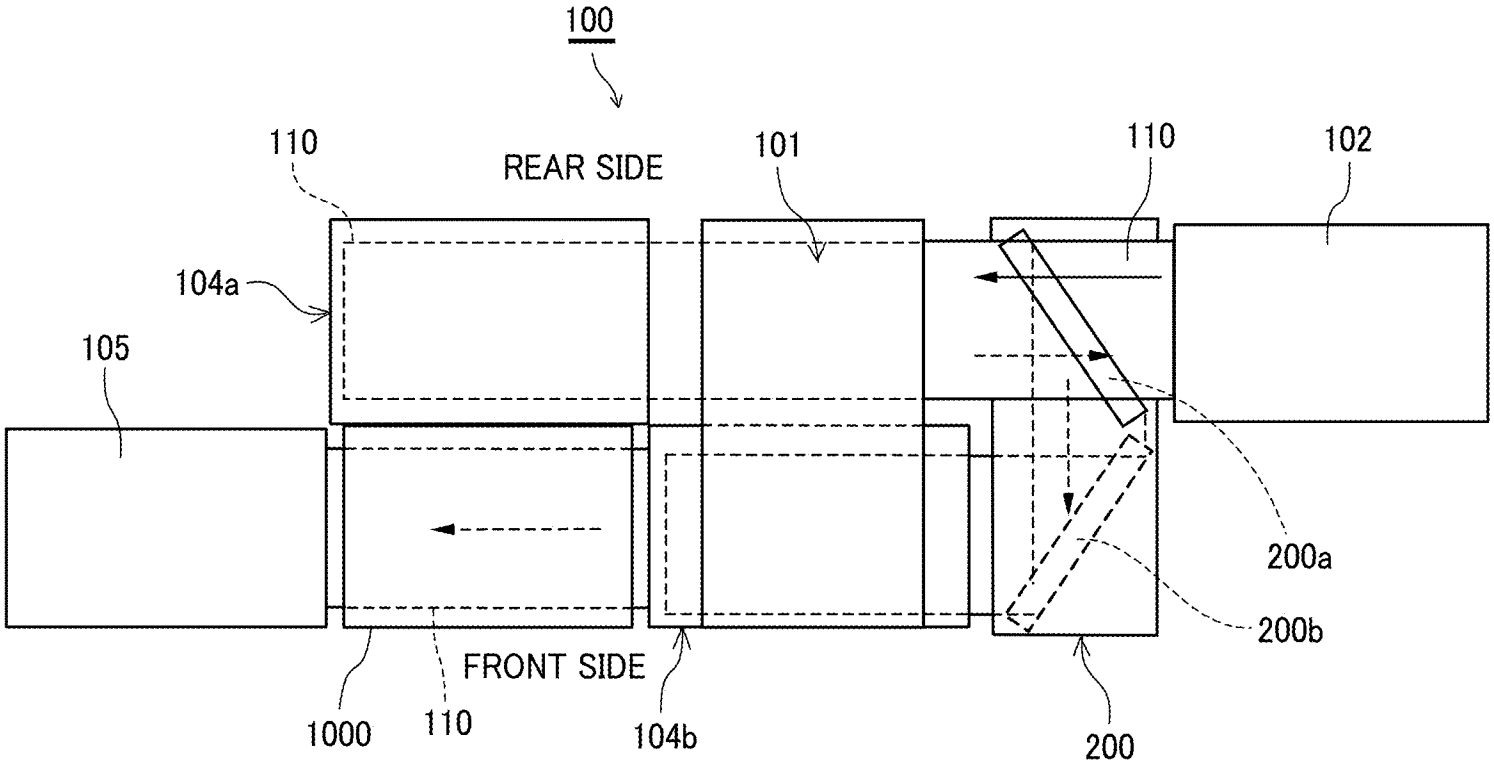
FIG. 28 is a schematic plan view of a printer according to a nineteenth embodiment of the present disclosure.
Figure 29:
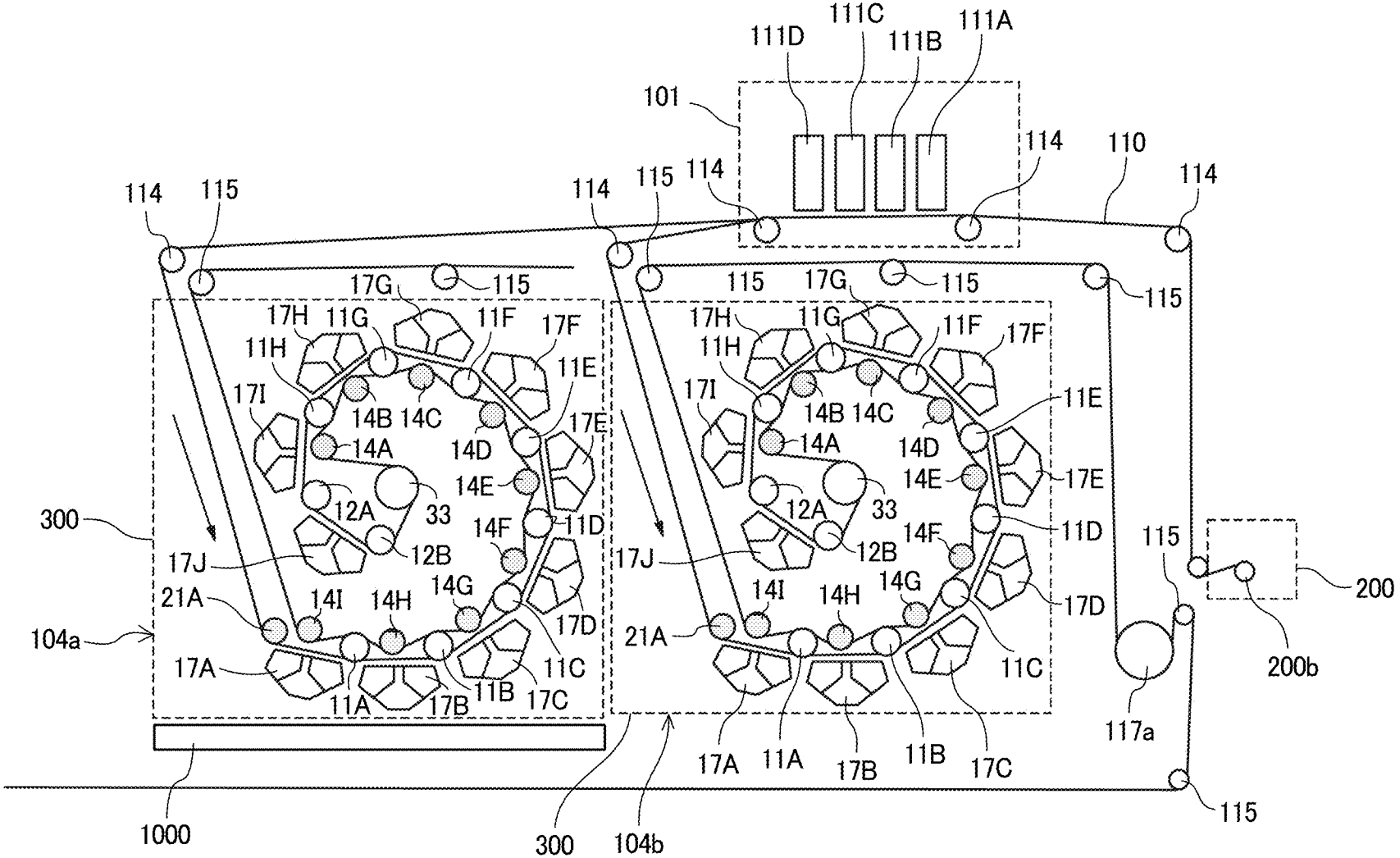
FIG. 29 is a schematic cross-sectional front view of the printer according to the nineteenth embodiment of the present disclosure.

Next, a printer 100 according to a nineteenth embodiment of the present disclosure is described with reference to FIGS. 28 and 29. FIG. 28 is a plan view of the printer 100 according to the nineteenth embodiment of the present disclosure. FIG. 29 is a schematic cross-sectional front view of the printer 100 according to the nineteenth embodiment of the present disclosure.

The printer 100 according to the nineteenth embodiment in FIG. 28 is different from the seventeenth embodiment in FIG. 21 such that the first dryer 104*a* and the second dryer 104*b* are arranged in parallel and are shifted (staggered) in the conveyance direction (lateral direction in FIG. 28) of the web 110. The web 110 passed the conveyance path below the second dryer 104*b* is conveyed below a maintenance table 1000 as illustrated in FIG. 29.

The maintenance table 1000 is disposed in front of the first dryer 104*a* and beside the second dryer 104*b*. Therefore, a person who maintains the printer 100 can get on the maintenance table 1000 and access the first dryer 104*a* from the front side of the printer 100 to maintenance the first dryer 104*a*. Thus, both the first dryer 104*a* and the second dryer 104*b* are accessible from the front side (from the same side) of the printer 100, and maintainability of the printer 100 is thus improved.

Figure 30:
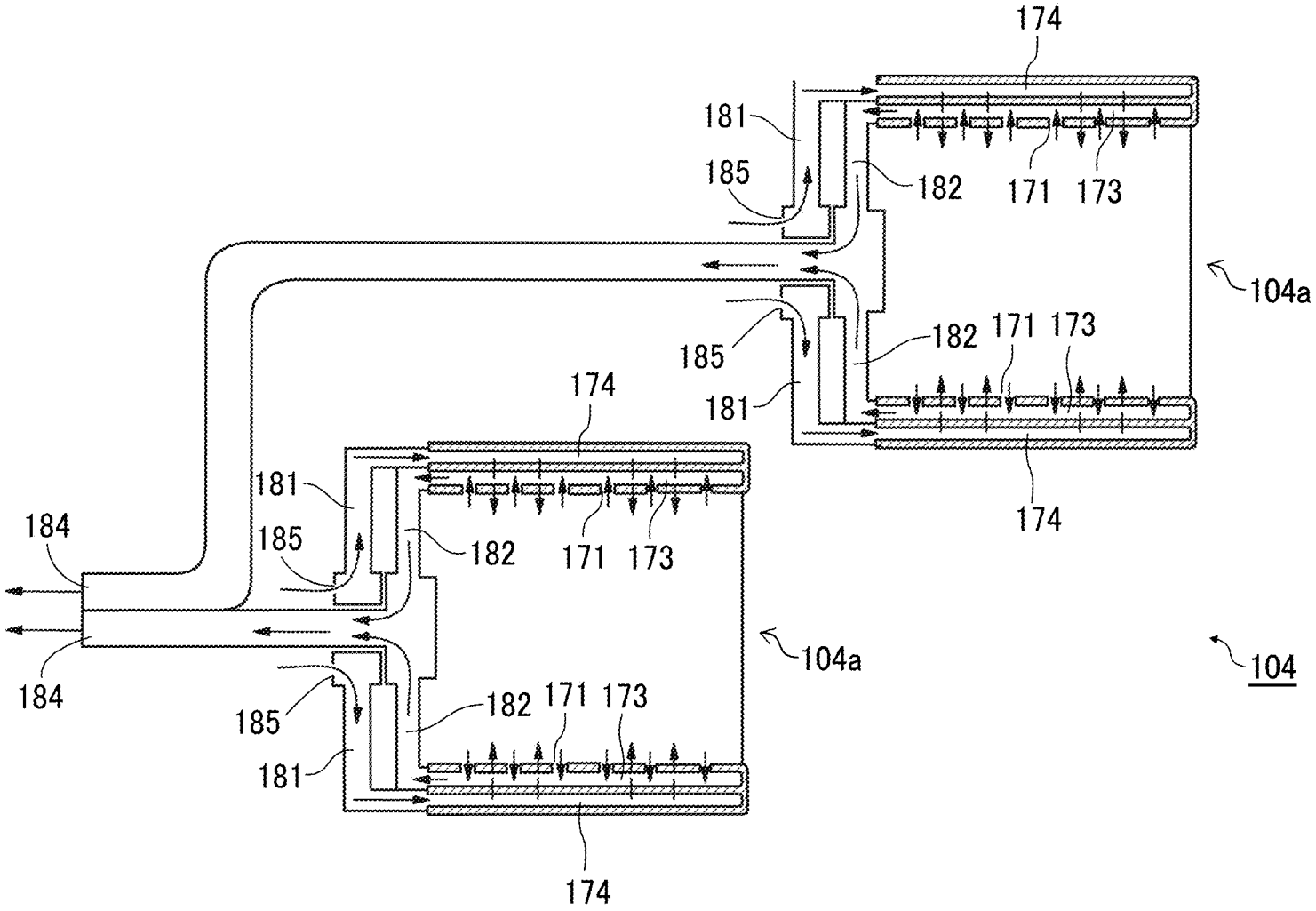
FIG. 30 is a cross-sectional side view of a dryer in the printer according to the twentieth embodiment of the present disclosure illustrating an airflow path of the dryer.

Next, an airflow path in the dryer 104 of the printer 100 according to a twentieth embodiment of the present disclosure is described with reference to FIG. 30. FIG. 30 is a schematic cross-sectional side view of the airflow path in the dryer 104 of the printer 100 according to the twentieth embodiment of the present disclosure.

The dryer 104 in the twentieth embodiment includes the airflow paths of the second dryer 104*b* illustrated in the eighteenth embodiment (see FIG. 27) applied to the first dryer 104*a* and the second dryer 104*b*, respectively. Further, the dryer 104 includes exhaust holes 184 for each of the first dryer 104*a* and the second dryer 104*b* on the rear side of the printer 100.

The first dryer 104*a* and the second dryer 104*b* can have the same configuration that facilitates assembly and maintenance. Since the dryer 104 does not include a duct on the front side of the first dryer 104*a* and the second dryer 104*b*, the printer 100 is accessible from the front side of the printer 100.

The first dryer 104*a* and the second dryer 104*b* may be applied with a configuration illustrated in FIG. 26 in the sixteenth embodiment in which an airflow is introduced from the front and rear direction of the printer 100 and is exhausted from the rear side of the printer 100.

As described in the above embodiments, the drying device 300 preferably has a configuration in which the web 110 is conveyed in the conveyance path of the drying device 300 such that the liquid application surface of the web 110 faces outside of the conveyance path when the web 110 enters the drying device 300.

Further, in each of the above-described embodiments, the plurality of heating rollers 11A to 11G are arranged on the locus of the substantially elliptic arc Ca (see FIG. 5). However, a locus of an arrangement of the plurality of heating rollers 11A to 11G is not limited to the substantially elliptic arc shape as long as a height of the locus is reduced to the height Ha (see FIG. 5). For example, the plurality of heating rollers 11A to 11G may be arranged in an arc shape along a locus of the true arc Cb in FIG. 5 as long as a height of the true arc Cb is reduced to Ha.

In each of the above-described embodiments, the drying device 300 includes the heating drums 13A and 13B or the heating roller 12 inside the folding path 10 formed by the heating rollers 11 and the guide rollers 14.

Further, the folding paths 10 may be arranged on both sides in a direction in which the heating drum 13A and the heating drum 13B are arranged. Further, the folding path 10 may face a path from the heating drum 13A to the heating drum 13B.

Further, a length of the path from the heating drum 13A to the heating drum 13B may be shorter than a length of the folding path 10 in a longitudinal direction of the folding path 10. The folding path 10 faces the path from the heating drum 13A to the heating drum 13B. Further, a region formed by the heating drums 13A and 13B and the folding path 10 may be flat. Thus, the printer 100 can reduce a space of the drying device 300 while ensuring the required drying property with such an arrangement as described above.

In each of the above-described embodiments, an example is described in which a web serving as a drying object, a printing object, and a conveyance object is a continuous sheet. For example, a web may include a continuous material such as a continuous paper, a continuous sheet, a roll sheet, and the like. A sheet may include wallpaper or an electronic circuit board sheet (e.g., prepreg) in addition to a web.

The printer may print recording images such as characters and figures with a liquid such as ink on a printing object. Further, the printer may print an arbitrary image such as a pattern on the printing object with a liquid such as ink for purposes such as decoration.

The liquid to be applied is not particularly limited, but it is preferable that the liquid has a viscosity of less than or equal to 30 mPa·s under a normal temperature and a normal pressure or by being heated or cooled.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as a liquid application device, examples of an energy generation source to discharge a liquid include an energy generation source using a piezoelectric actuator (a lamination piezoelectric element and a thin-film piezoelectric element), a thermal actuator using an electrothermal transducer element such as a heating resistor, a static actuator including a diaphragm plate and opposed electrodes, and the like.

The terms "printing" in the present embodiment may be used synonymously with the terms of "image formation", "recording", "printing", and "image printing".

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A drying device comprising:

a first-heating rotator configured to contact a sheet twice from different directions; and at least three second-heating rotators each configured to contact the sheet once, wherein the at least three second-heating rotators are in a conveyance path configured to guide the sheet to contact the first-heating rotator again after the sheet contacts and passes the first-heating rotator.

2. The drying device according to claim 1, wherein the at least three second-heating rotators contact one surface of the sheet that contacts the first-heating rotator.

3. The drying device according to claim 1, wherein the at least three second-heating rotators include two second-heating rotators each having a larger diameter than another second-heating rotator other than the two second-heating rotators.

4. The drying device according to claim 1, wherein at least one of the at least three second-heating rotators has a same diameter as the first-heating rotator.

5. The drying device according to claim 1, wherein the at least three second-heating rotators include:

a last second-heating rotator configured to contact a portion of the sheet last; and a first second-heating rotator configured to contact the portion of the sheet first, and the last second-heating rotator has a larger diameter than the first second-heating rotator.

6. The drying device according to claim 1, further comprising:

a guide roller in a folding path in the conveyance path, wherein the folding path is configured to guide one surface of the sheet to contact the first-heating rotator again after the one surface of the sheet contacts and passes the at least three second-heating rotators.

7. The drying device according to claim 1, further comprising a plurality of first-heating rotators including the first-heating rotator, wherein the plurality of first-heating rotators are on a locus having an elliptic arc shape.

8. The drying device according to claim 1, further comprising a plurality of third-heating rotators and a plurality of guide rollers that alternately contact one surface and another surface of the sheet after the one surface of the sheet contacts and passes the at least three second-heating rotators and the first-heating rotator.

9. A printer comprising:

the drying device according to claim 1, and a liquid application device configured to apply a liquid onto the sheet.

10. A drying device comprising:

a first-heating rotator configured to contact a sheet twice from different directions;

at least two second-heating rotators each configured to contact the sheet once; and wherein each of the at least two second-heating rotators has a larger diameter than the first-heating rotator, and the at least two second-heating rotators are in a conveyance path configured to guide the sheet to contact the first-heating rotator again after the sheet contacts and passes the first-heating rotator.

11. The drying device according to claim 10, wherein the at least two second-heating rotators contact one surface of the sheet that contacts the first-heating rotator.

12. The drying device according to claim 10, further comprising:

a guide roller having a smaller diameter than each of the at least two second-heating rotators, wherein the guide roller is in the conveyance path configured to guide the sheet to contact the first-heating rotator again after the sheet contacts and passes the first-heating rotator.

13. The drying device according to claim 11, further comprising:

a blower configured to blow an air to another surface opposite to the one surface of the sheet contacting the at least two second-heating rotators, wherein the another surface of the sheet faces an exterior of the drying device, and the blower blows the air inward of the drying device.

14. The drying device according to claim 10, wherein one of the at least two second-heating rotators is higher than another of the at least two second-heating rotators.

15. The drying device according to claim 10, further comprising a plurality of first-heating rotators that includes the first-heating rotator, wherein the plurality of first-heating rotators is on a locus having an elliptic arc shape.

16. A printer comprising:

the drying device according to claim 10, and a liquid application device configured to apply a liquid onto the sheet.

17. A drying device comprising:

a heater configured to heat a sheet;

at least three second-heating rotators each configured to contact once one surface of the sheet having passed the heater; and a plurality of first-heating rotators configured to contact and heat the one surface of the sheet after the one surface of the sheet contacts the at least three second-heating rotators, wherein the at least three second-heating rotators are in an interior of a conveyance path configured to guide the sheet to contact and pass the plurality of first-heating rotators.

18. The drying device according to claim 17, wherein the at least three second-heating rotators include two second-heating rotators, and each of the two second-heating rotators has a larger diameter than one of the plurality of first-heating rotators.

19. A printer comprising:

the drying device according to claim 17, and a liquid application device configured to apply a liquid onto the sheet.

* * * * *